US012723493B2

(12) United States Patent
Amezaga et al.

(10) Patent No.: US 12,723,493 B2
(45) Date of Patent: Sep. 1, 2026

(54) MECHANICAL CASING RUNNING TOOL

(71) Applicant: WEATHERFORD TECHNOLOGY HOLDINGS, LLC, Houston, TX (US)

(72) Inventors: Federico Amezaga, Cypress, TX (US); Martin Liess, Seelze (DE); Ernst Fuehring, Lindhorst (DE)

(73) Assignee: WEATHERFORD TECHNOLOGY HOLDINGS, LLC, Houston, TX (US)

( * ) Notice: Subject to any disclaimer, the term of this patent is extended or adjusted under 35 U.S.C. 154(b) by 0 days.

(21) Appl. No.: 19/041,144

(22) Filed: Jan. 30, 2025

(65) Prior Publication Data

US 2026/0218593 A1 Jul. 30, 2026

Related U.S. Application Data

(60) Provisional application No. 63/750,343, filed on Jan. 28, 2025.

(51) Int. Cl.
*E21B 17/042* (2006.01)
*E21B 43/10* (2006.01)

(52) U.S. Cl.
CPC ..... *E21B 43/10* (2013.01)

(58) Field of Classification Search
CPC ..... E21B 17/021; E21B 17/042; E21B 19/16; E21B 19/10; E21B 31/20
See application file for complete search history.

(56) References Cited

U.S. PATENT DOCUMENTS 3,179,180 A * 4/1965 Hart ..... E21B 17/06 166/216
3,469,628 A * 9/1969 Conrad ..... E21B 33/1292 166/134
4,440,218 A * 4/1984 Farley ..... E21B 23/006 166/51
6,732,822 B2 5/2004 Slack et al.
(Continued)

FOREIGN PATENT DOCUMENTS

CN 112412341 A 2/2021
WO 2024092342 A1 5/2024

OTHER PUBLICATIONS

English language Abstract of CN112412341A, downloaded from Espacenet Oct. 16, 2024.
(Continued)

*Primary Examiner* — Catherine Loikith
(74) *Attorney, Agent, or Firm* — Smith IP Services, P.C.

(57) ABSTRACT

A method of handling a casing section can include rotating a mandrel of a casing running tool in a rotational direction, thereby making-up or breaking-out a threaded connection, then rotating the mandrel in an opposite rotational direction, and applying a longitudinally compressive load to the casing running tool, thereby retracting slips of the casing running tool out of gripping engagement with the casing section. A casing running tool can include a tubular mandrel, slips configured to grip a casing section in response to rotation of the mandrel, a make-up activation sleeve configured to displace in a longitudinal direction in response to rotation of the mandrel in a rotational direction, and a break-out activation sleeve configured to displace in an opposite longitudinal direction in response to the rotation of the mandrel in the rotational direction.

17 Claims, 22 Drawing Sheets

(56) References Cited

U.S. PATENT DOCUMENTS

| | | | | |
|---|---|---|---|---|
| 7,350,586 | B2 | 4/2008 | Guidry | |
| 7,909,120 | B2 * | 3/2011 | Slack | E21B 3/022 175/423 |
| 8,100,187 | B2 | 1/2012 | Begnaud et al. | |
| 8,424,939 | B2 | 4/2013 | Slack | |
| 9,010,433 | B2 | 4/2015 | Rios, III et al. | |
| 9,416,601 | B2 | 8/2016 | Mullins et al. | |
| 9,869,143 | B2 | 1/2018 | Slack | |
| 10,081,989 | B2 | 9/2018 | Slack | |
| 10,907,424 | B2 | 2/2021 | Lutgring et al. | |
| 10,975,633 | B2 | 4/2021 | Hickl | |
| 11,002,086 | B2 | 5/2021 | Magnuson et al. | |
| 11,255,154 | B2 * | 2/2022 | Fagna | E21B 34/142 |
| 11,299,940 | B2 | 4/2022 | Slack | |
| 11,313,183 | B2 | 4/2022 | Slack | |
| 11,332,985 | B1 | 5/2022 | Slack | |
| 11,560,761 | B2 | 1/2023 | Slack | |
| 11,965,385 | B2 | 4/2024 | Sonnier et al. | |
| 12,044,076 | B2 | 7/2024 | Henderson et al. | |
| 2005/0000684 | A1 | 1/2005 | Slack et al. | |
| 2009/0114398 | A1 | 5/2009 | Buytaert et al. | |
| 2015/0107851 | A1 | 4/2015 | Mullins et al. | |
| 2022/0154540 | A1 | 5/2022 | Slack et al. | |
| 2022/0259930 | A1 | 8/2022 | Slack | |
| 2022/0333449 | A1 | 10/2022 | Infante | |
| 2024/0068307 | A1 | 2/2024 | Amezaga et al. | |

OTHER PUBLICATIONS

International Search Report with Written Opinion issued Mar. 6, 2026 for PCT Patent Application No. PCT/IS2025/063533, 12 pages.

* cited by examiner

MECHANICAL CASING RUNNING TOOL

CROSS-REFERENCE TO RELATED APPLICATION

This application claims the benefit of the filing date of U.S. provisional application No. 63/750,343 filed on 28 Jan. 2025. The entire disclosure of the prior application is incorporated herein by this reference for all purposes.

BACKGROUND

This disclosure relates generally to equipment utilized and operations performed in conjunction with a subterranean well and, in an example described below, more particularly provides a mechanical casing running tool.

A casing running tool is typically used to grip, support, and transmit force and torque to casing. A casing running tool may be used in casing running operations to make-up threaded connections between casing sections (stands or joints of casing), or in casing pulling operations to break-out threaded connections.

Preferably, a casing running tool allows for safe, rapid and efficient casing running and pulling operations. The casing running tool should minimize or eliminate a need for presence of personnel on a rig floor to run casing.

Therefore, it will be readily appreciated that improvements are continually needed in the art of designing, constructing and operating casing running tools. The present specification provides such improvements, which may be used with a wide variety of different rig configurations and well operations.

DETAILED DESCRIPTION

Figure 1:
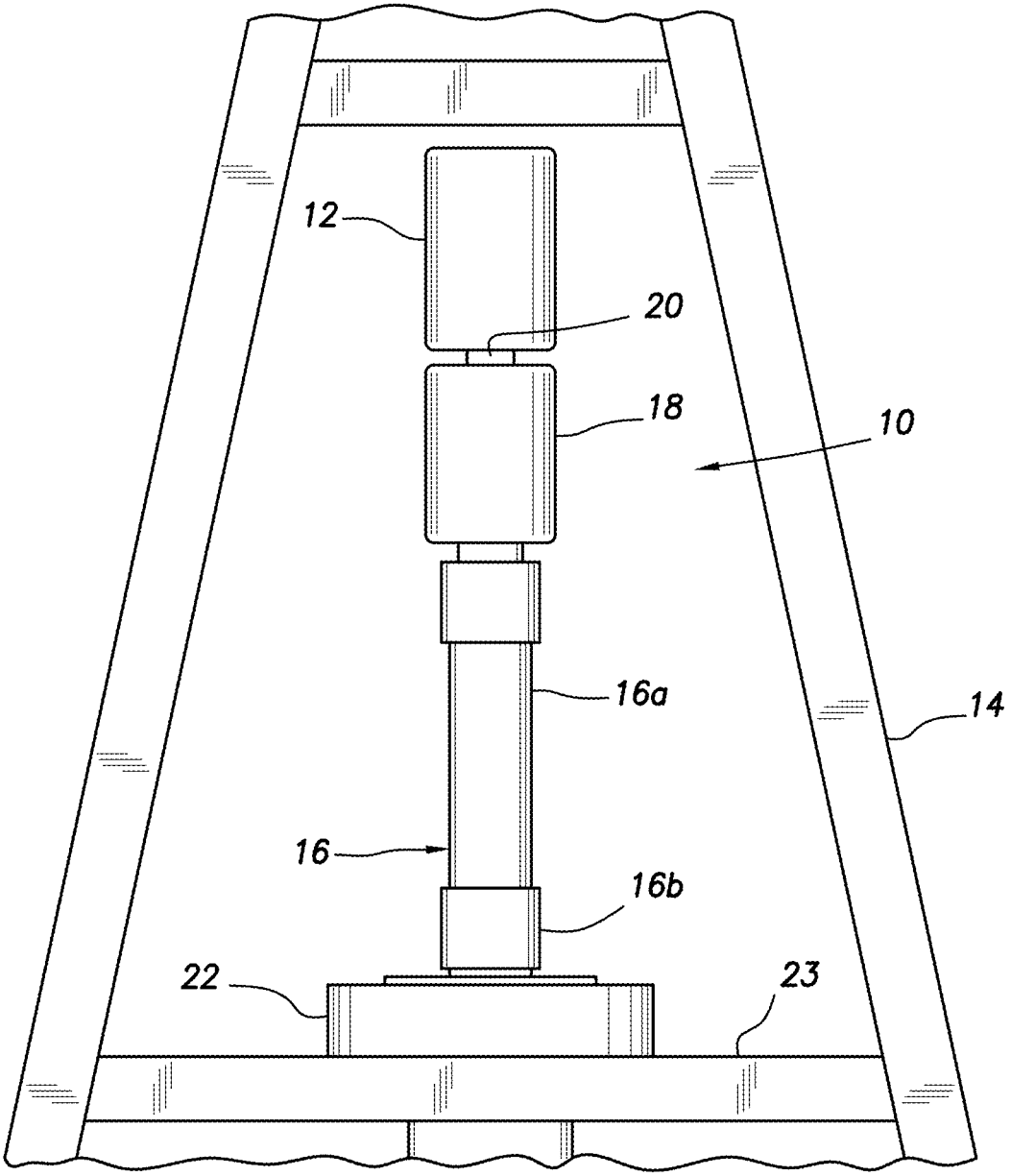
FIG. 1 is a representative elevational view of an example of a well system and associated method which can embody principles of this disclosure.

Representatively illustrated in FIG. 1 is a system 10 for use with a subterranean well, and an associated method, which can embody principles of this disclosure. However, it should be clearly understood that the system 10 and method are merely one example of an application of the principles of this disclosure in practice, and a wide variety of other examples are possible. Therefore, the scope of this disclosure is not limited at all to the details of the system 10 and method described herein and/or depicted in the drawings.

In the FIG. 1 example, a top drive 12 is used to handle various tubulars and to make-up connections between the tubulars. A conventional top drive is typically mounted to generally vertical parallel rails (not shown) of a well rig 14. The top drive 12 is displaced along the rails to thereby raise or lower a tubular string suspended from the top drive. The rig 14 may be land-based or water-based.

As depicted in FIG. 1, the top drive 12 is being used to handle sections 16*a,b* of a casing string 16, and to make-up a connection between the casing string sections. A casing running tool 18 is connected between the top drive 12 and the upper casing section 16*a*.

The casing running tool 18 selectively grips the upper casing section 16*a* and enables transmission of torque and rotation from the top drive 12 (e.g., via a quill 20 of the top drive) to an upper end of the upper casing section. In this example, the casing running tool 18 selectively grips an internal surface of the casing section 16*a*. A conventional casing running tool can also include external safety bails (not shown) to prevent inadvertent release of the casing section from the casing running tool.

A torque sensor (such as, a load cell) and a turns or rotation sensor (not shown in FIG. 1) may be connected with the casing running tool 18 between the top drive 12 and the upper casing section 16*a*. The torque and rotation sensors may be included in a separate tool (sometimes referred to as a "torque sub"), or the sensors may be incorporated into the casing running tool 18. The torque sensor provides an indication of torque output by the top drive 12, and the rotation sensor provides an indication of rotation output by the top drive.

In the FIG. 1 example, the lower casing section 16*b* is gripped and suspended in the well by a casing spider 22 mounted to a floor 23 of the rig 14. When the upper casing section 16*a* is gradually lowered and rotated by the top drive 12 via the casing running tool 18, a lower threaded end of the upper casing section is threaded into an upper threaded end of the lower casing section 16*b*, so that a threaded connection is formed between the casing sections.

The torque and rotation outputs of the top drive 12 are used to make-up the connection between the casing sections 16*a,b* according to specific requirements in a casing running operation. In a casing pulling operation, the torque and rotation outputs of the top drive 12 are used to break-out the connection between the casing sections 16*a,b*.

The term "casing" as used herein indicates a tubular protective well lining and can include various types of tubulars known to those skilled in the art as casing, liner or pipe. As depicted in FIG. 1, each of the casing sections 16*a,b* comprises a single "joint" of casing that includes a length of casing and a coupling threaded to an upper end of the length of casing. In other examples, a casing string section can include multiple joints of casing, forming a "stand" of casing. In further examples, a separate coupling may not be used with each length of casing.

In the FIG. 1 example, the casing running tool 18 is mechanically actuated and does not require hydraulic, pneumatic or electrical inputs for its operation. Instead, the casing running tool 18 can be operated solely by outputs (torque and loads) delivered via the top drive 12. Personnel do not need to be present on the rig floor 23 for operation of the casing running tool 18.

Some potential benefits of features of the casing running tool 18 example described more fully below can include, but are not limited to, an initial slip gripping force is provided by compressed springs, the gripping force increases with increased torque output by the top drive 12, set down load can be applied during drilling and reaming operations, and externally visible indicators show a state of the tool at all times. However, it is not necessary for any particular benefit or combination of benefits to be provided in keeping with the scope of this disclosure.

Figure 2:
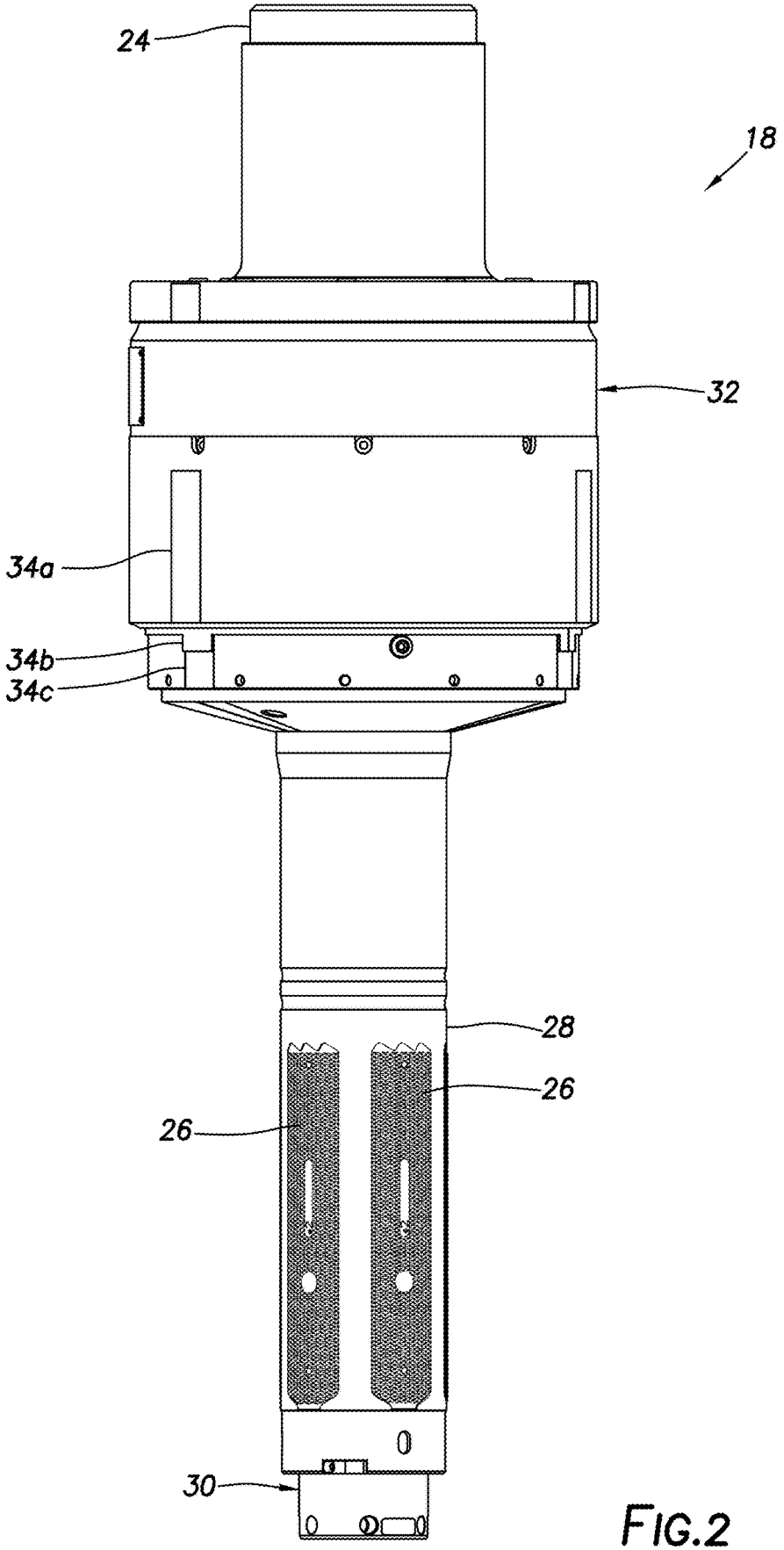
FIG. 2 is a representative side view of a casing running tool that may be used with the FIG. 1 system and method.

Referring additionally now to FIG. 2, a representative side view of an example of the casing running tool 18 is depicted. For convenience, the casing running tool 18 is described below as it may be used with the FIG. 1 system 10 and method, but the casing running tool may be used with other systems and methods in other examples.

As depicted in FIG. 2, the casing running tool 18 includes an upper connector 24 for connecting the tool to the quill 20 of the top drive 12. If a separate torque sub is used, the torque sub may be connected between the top drive 12 and the upper connector 24.

Near a lower end of the casing running tool 18, multiple circumferentially distributed slips 26 are retained in a slip cage 28. The slips 26 are radially extendable and retractable through openings in the slip cage 28 to respectively grip or release an internal surface of a casing (such as, the FIG. 1 upper casing section 16*a*). In this example, the slips 26 are configured to provide for transmission of torque and longitudinal load between the tool 18 and the casing when the slips are extended and grip the internal surface of the casing.

A generally tubular mandrel 30 extends longitudinally through the tool 18. In this example, the upper connector 24 is formed at an upper end of the mandrel 30. A lower end of the mandrel 30 extends outwardly from the slip cage 28 and is configured for connection of a conventional packer (not shown) to the mandrel. The packer, when used, seals against the internal surface of the casing and thereby provides for circulation of fluid through the casing when the tool 18 is stabbed into the casing.

As described more fully below, the mandrel 30 is configured so that the slips 26 can be extended outward to grip the internal surface of the casing by displacement of the slips and slip cage 28 downward relative to the mandrel. The slips 26 can be retracted inward to release the casing by displacement of the slips and slip cage 28 upward relative to the mandrel 30.

The tool 18 includes an activation section 32, which controls the displacement of the slips 26 and slip cage 28 relative to the mandrel 30. In this example, the activation section 32 includes multiple sets of circumferentially distributed externally visible indicators 34*a-c* to enable an operator or driller to conveniently ascertain or confirm a state or configuration of the activation section 32 at any time. Various positions of the visual indicators 34*a-c* are depicted in FIGS. 18A-E and described more fully below.

Figure 3:
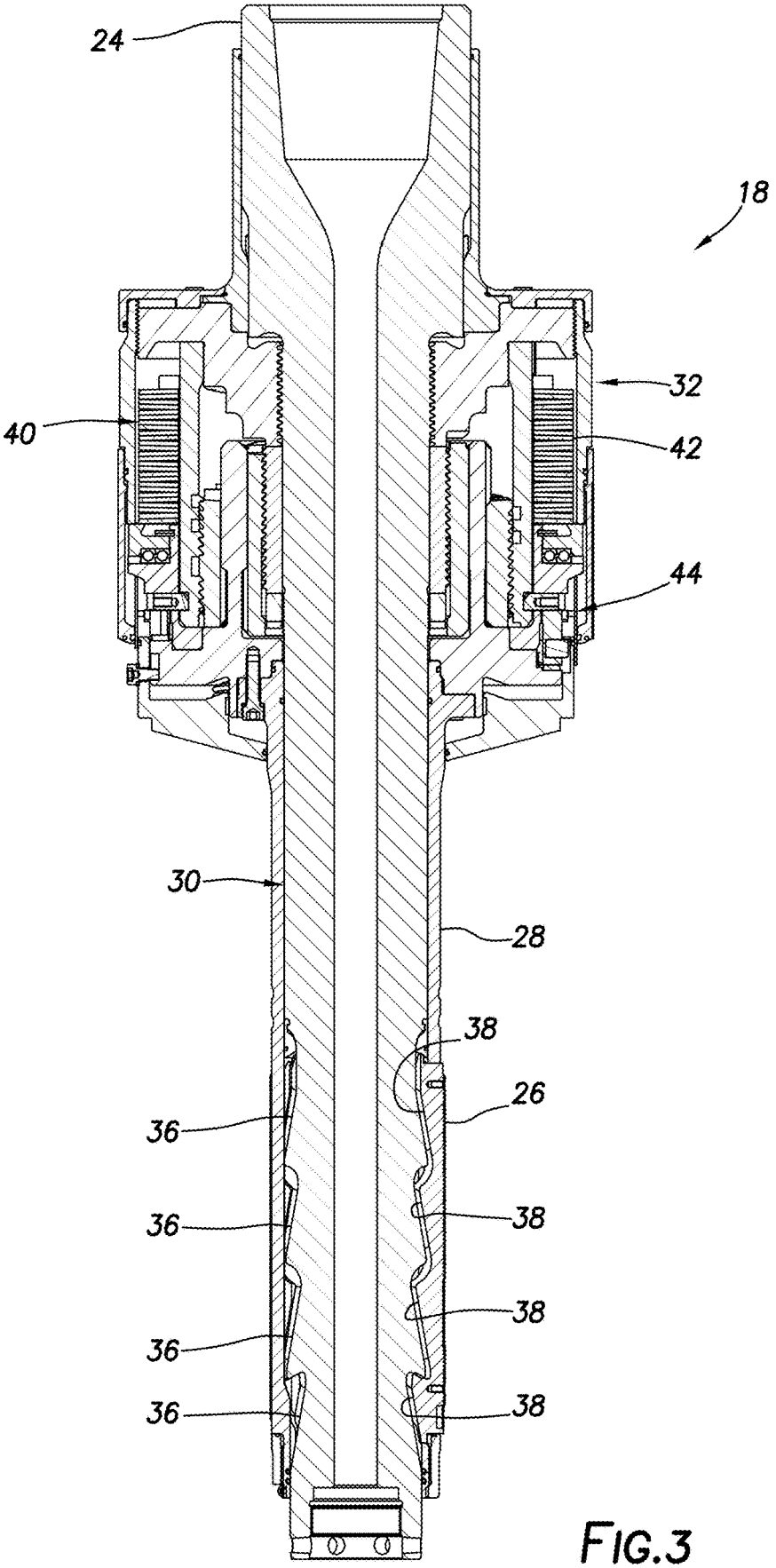
FIG. 3 is a representative cross-sectional view of the casing running tool.

Referring additionally now to FIG. 3, a representative cross-sectional view of the casing running tool 18 is depicted. In this view, internal components of the tool 18 are visible.

The mandrel 30 has multiple frustoconical ramps 36 formed externally thereon that engage internal inclined surfaces 38 formed in each of the slips 26. The ramps 36 and surfaces 38 are oriented so that, when the slips 26 are displaced downward relative to the mandrel 30 by operation of the activation section 32, the slips are displaced radially outward. When the slips 26 are subsequently displaced upward relative to the mandrel 30 by operation of the activation section 32, the slips are retracted radially inward.

The activation section 32 includes a biasing device 40 to provide an initial downwardly directed force to the slip cage 28 when it is desired to extend the slips 26. In this example, the biasing device 40 is in the form of a stack of springs 42 of the type known to those skilled in the art as Belleville washers. However, other types of springs or other biasing devices (such as, a coiled spring, a compressed resilient material, etc.) may be used in other examples.

The biasing device 40 is prevented from applying the downwardly directed force to the slip cage 28 by a latch mechanism 44 when it is not desired for the slips 26 to be extended. In threaded connection make-up or break-out operations, the latch mechanism 44 is released to permit the biasing device 40 to apply the downwardly directed force to the slip cage 28 after the tool 18 is stabbed into the casing. After the make-up or break-out operation is completed, the biasing device 40 is compressed and the latch mechanism 44 is reset to prevent application of the downwardly directed force to the slip cage 28 prior to withdrawing the tool 18 from the casing.

Figure 4:
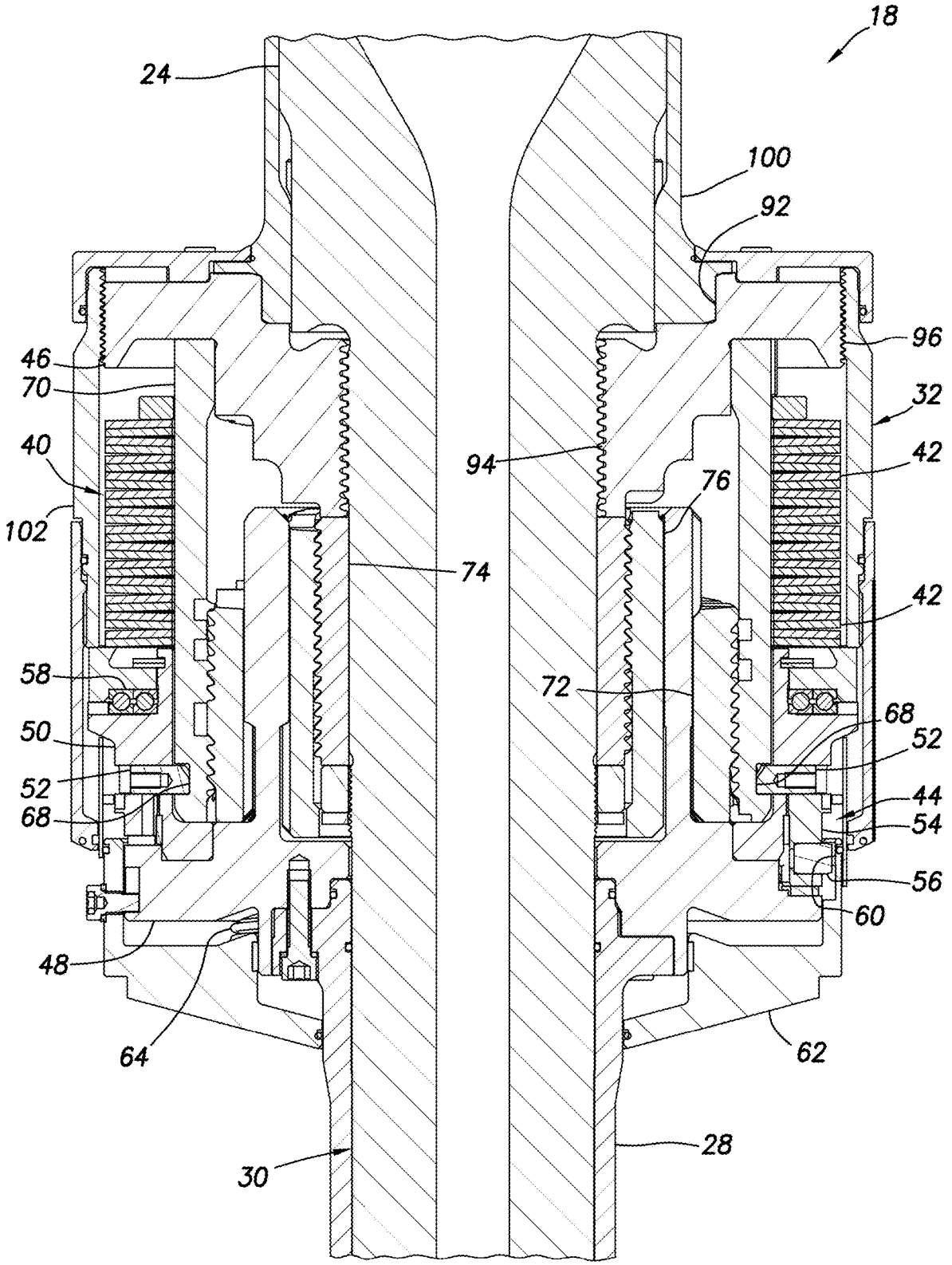
FIG. 4 is a representative cross-sectional view of an activation section of the casing running tool.

Referring additionally now to FIG. 4, a representative cross-sectional view of the activation section 32 of the casing running tool 18 is depicted. In this view, internal components of the activation section 32 can be more clearly seen.

In the FIG. 4 example, the activation section 32 includes the biasing device 40 with the springs 42 compressed between an upper support 46 and a lower support 48. The upper support 46 is secured to the mandrel 30 below the upper connector 24. The lower support 48 is secured to the slip cage 28.

Thus, a biasing force exerted by the compressed springs 42 would act to displace the slip cage 28 downward to extend the slips 26 outward (see FIG. 3), except that the latch mechanism 44 prevents transmission of the biasing force from the springs to the lower support 48. The latch mechanism 44 in this example includes a latch support 50, multiple circumferentially distributed latch members 52, a synchronization ring 54 and multiple circumferentially distributed pins 56 (only one of which is visible in FIG. 4).

The latch support 50 is positioned between, and transmits loads between, the biasing device 40 and the lower support 48. A set of bearings 58 provides for relatively unrestricted rotation of the latch support 50 under load.

The latch members 52 are radially displaceable relative to the synchronization ring 54. As described more fully below, rotation of the synchronization ring 54 causes the latch members 52 to displace together radially inward or outward, depending on a direction of rotation of the synchronization ring.

The pins 56 are secured in openings formed in the synchronization ring 54 and extend radially outward from the synchronization ring. As depicted in FIG. 4, the pins 56 are received in respective multiple longitudinal slots 60 formed in a bumper 62 that is biased downward relative to the lower support 48 by multiple circumferentially distributed springs 64 (only one of which is visible in FIG. 4).

As described more fully below, the synchronization ring 54 is biased rotationally by springs 66 (not visible in FIG. 4, see FIG. 13), interposed between the synchronization ring and the lower support 48, toward a rotational position in which the latch members 52 are extended radially inward as depicted in FIG. 4. The synchronization ring 54 is maintained in this rotational position by the engagement of the pins 56 in the longitudinal slots 60 in the bumper 62.

As depicted in FIG. 4, the latch members 52 extend radially inward into engagement with respective recesses 68 formed in an internally threaded internal housing 70. While the latch members 52 are engaged in the recesses 68, the biasing force exerted by the compressed springs 42 is prevented from being transmitted to the lower support 48 and the slip cage 28.

A break-out activation sleeve 72 is engaged with the right-hand internal threads in the internal housing 70. The sleeve 72 is externally right-hand threaded. The internal housing 70 is constrained (as described more fully below) to rotate with the mandrel 30, and so left-hand (counter-clockwise, as viewed from above) rotation of the mandrel 30 and the internal housing will cause the sleeve 72 to displace downward. Right-hand (clockwise, as viewed from above) rotation of the mandrel 30 and the internal housing 70 will cause the sleeve 72 to displace upward.

An externally left-hand threaded sleeve 74 is secured to the mandrel 30 and constrained to rotate with the mandrel. In other examples, the left-hand threads could be formed directly on the mandrel 30 or the upper support 46, without use of the separate sleeve 74.

A make-up activation sleeve 76 is engaged with the left-hand external threads of the sleeve 74. The make-up activation sleeve 76 is internally left-hand threaded. Thus, right-hand (clockwise, as viewed from above) rotation of the mandrel 30 and the sleeve 74 will cause the make-up activation sleeve 76 to displace downward. Left-hand (counter-clockwise, as viewed from above) rotation of the mandrel 30 and the sleeve 74 will cause the make-up activation sleeve 76 to displace upward.

Note that each of the break-out and make-up activation sleeves 72, 76 abuts or nearly abuts the lower support 48 in the configuration depicted in FIG. 4. Thus, downward displacement of either of the break-out and make-up activation sleeves 72, 76 will also cause that sleeve to displace the lower support 48 and the attached slip cage 28 downward to thereby extend the slips 26 into gripping engagement with the internal surface of the casing.

Figure 5:
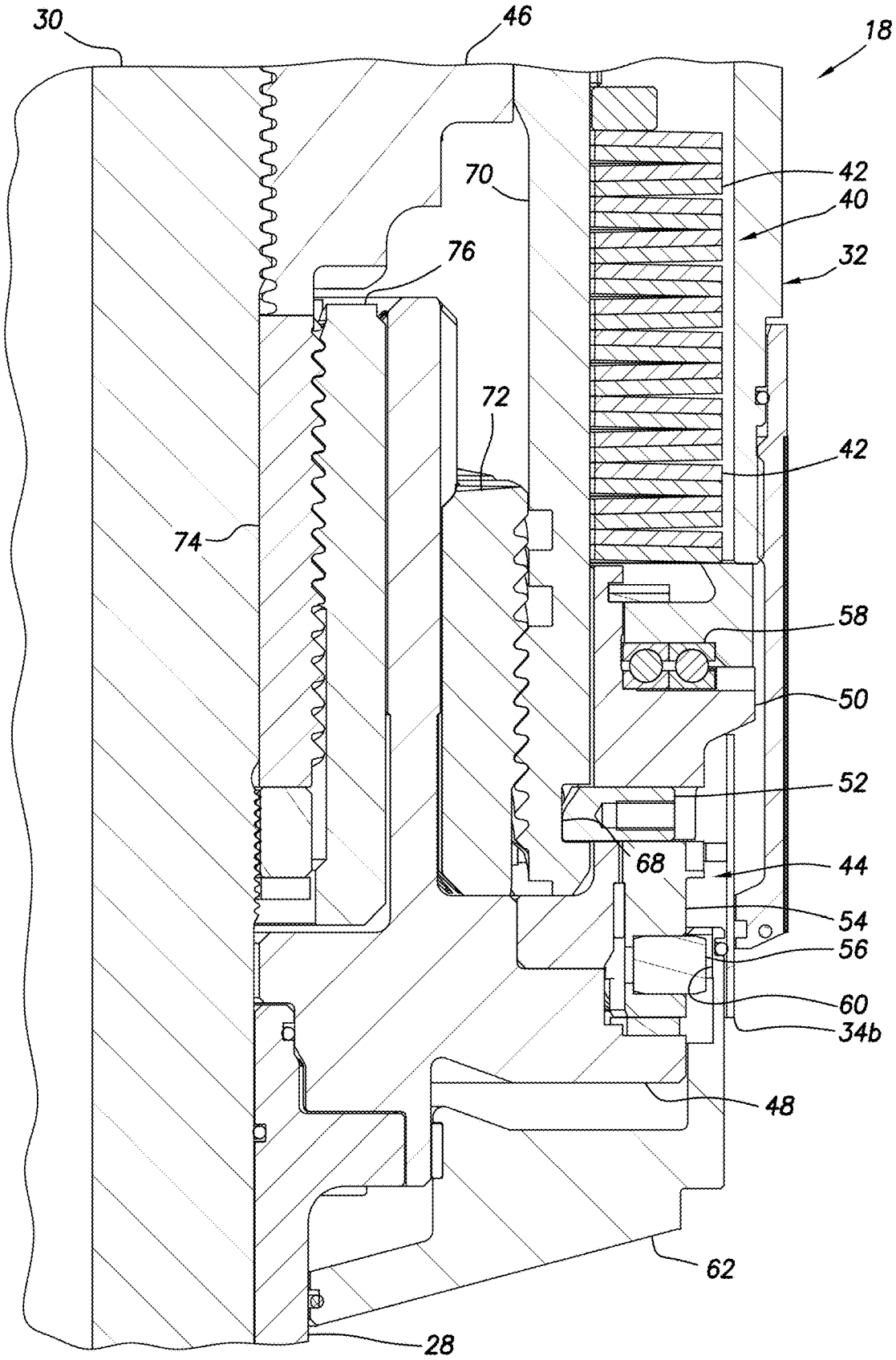
FIG. 5 is a representative cross-sectional view of a portion of the casing running tool in an initial configuration.

Referring additionally now to FIG. 5, a representative cross-sectional view of a portion of the casing running tool 18 in an initial configuration is depicted. The casing running tool 18 is in this initial configuration prior to stabbing the tool into a casing in preparation for a make-up or break-out operation, or after resetting the tool following a make-up or break-out operation.

In the initial configuration depicted in FIG. 5, the bumper 62 is maintained in its downwardly biased position relative to the lower support 48 by the springs 64 (see FIG. 4). Thus, the pins 56 remain engaged in the longitudinal slots 60.

The latch members 52 are radially inwardly extended into engagement with the recesses 68 in the internal housing 70. Thus, the biasing force exerted by the springs 42 is prevented from biasing the lower support 48 and the slip cage 28 downward. The slips 26 are in their radially retracted positions (see FIG. 3).

Figure 6:
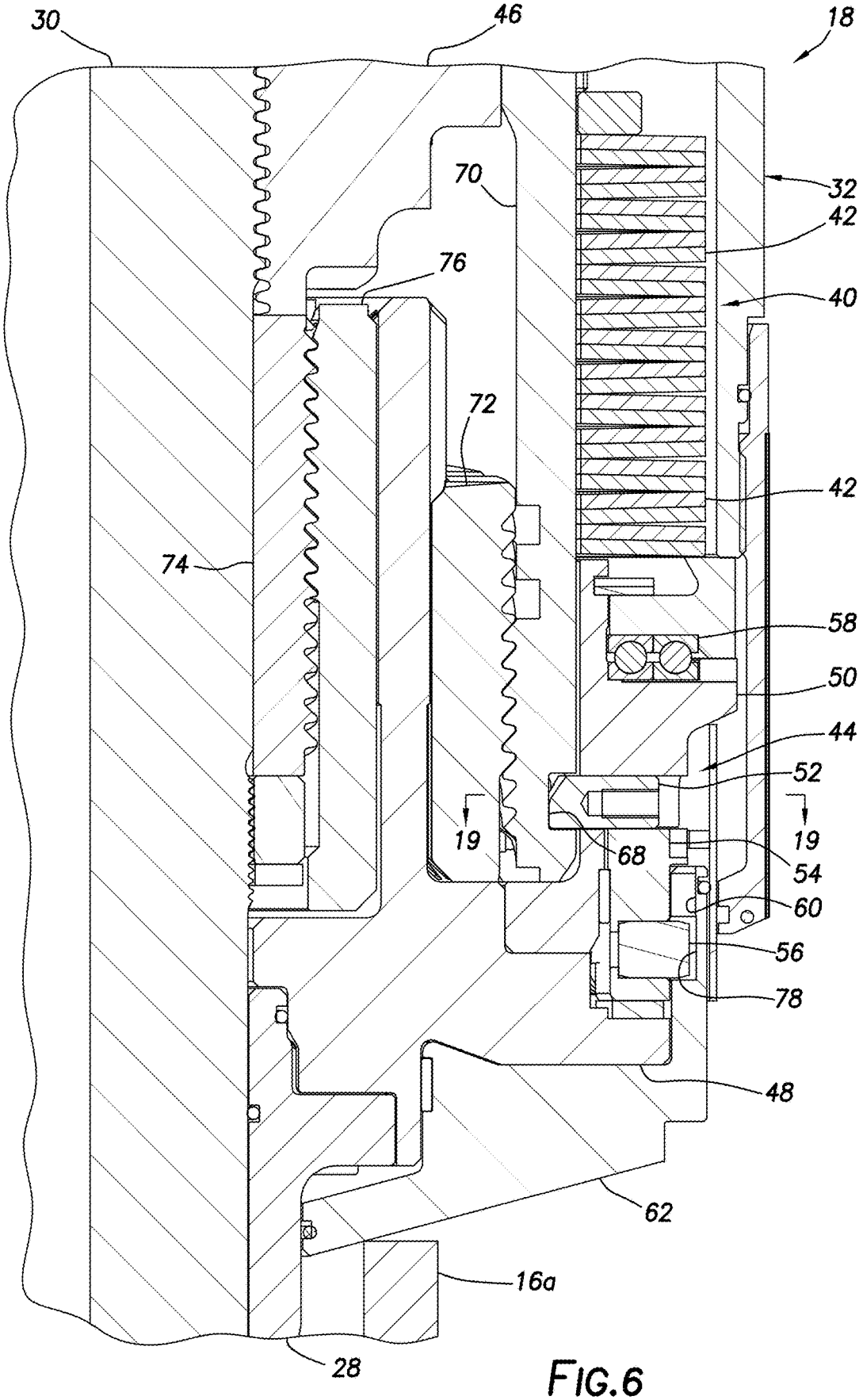
FIG. 6 is a representative cross-sectional view of the portion of the casing running tool in a bumper compressed configuration.

Referring additionally now to FIG. 6, a representative cross-sectional view of the portion of the casing running tool 18 in a bumper compressed configuration is depicted. In this configuration, the tool 18 has been stabbed into an upper end of the upper casing section 16*a* in preparation for a make-up or break-out of a threaded connection between the upper and lower casing sections 16*a,b* (see FIG. 1).

Set down weight (a vertically downwardly directed load) has been applied to the tool 18, for example, using the top drive 12. As a result, an upper end of the casing section 16*a* has contacted the bumper 62, and the lower support 48 has displaced into contact with the bumper.

Downward displacement of the synchronization ring 54 with the lower support 48 relative to the bumper 62 has caused the pins 56 to no longer be received in the longitudinal slots 60. Instead, the pins 56 are now received in respective circumferentially extending slots 78 formed in the bumper 62. As a result, a certain amount of limited rotation of the synchronization ring 54 is now permitted.

Figure 7:
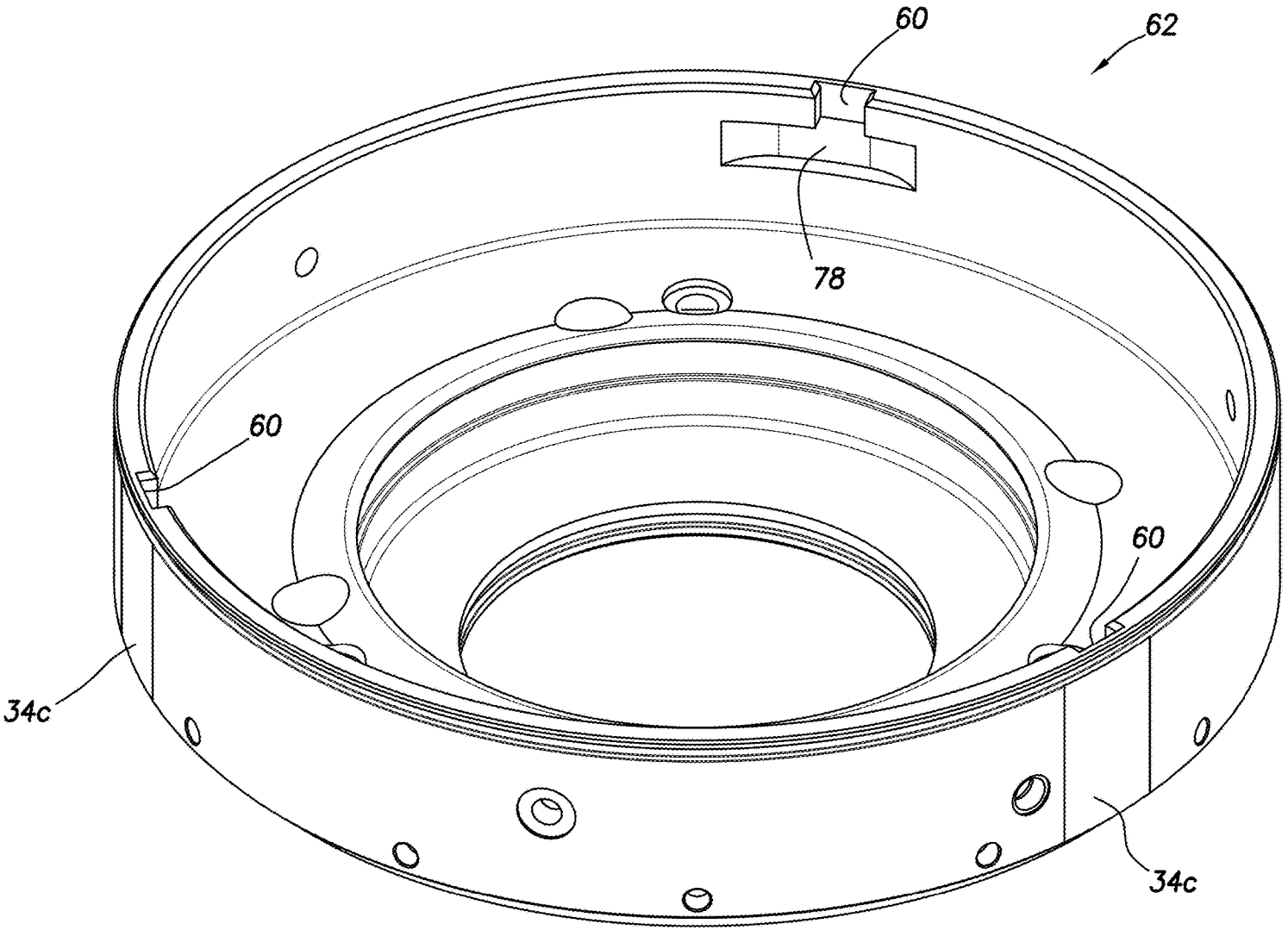
FIG. 7 is a representative perspective view of a bumper of the casing running tool.

Referring additionally now to FIG. 7, a representative perspective view of the bumper 62, apart from the remainder of the casing running tool 18, is depicted. In this view, the manner in which the engagement of the pins 56 in the circumferentially extending slots 78 in the bumper 62 permits limited rotation of the synchronization ring 54 can be appreciated.

Figure 8:
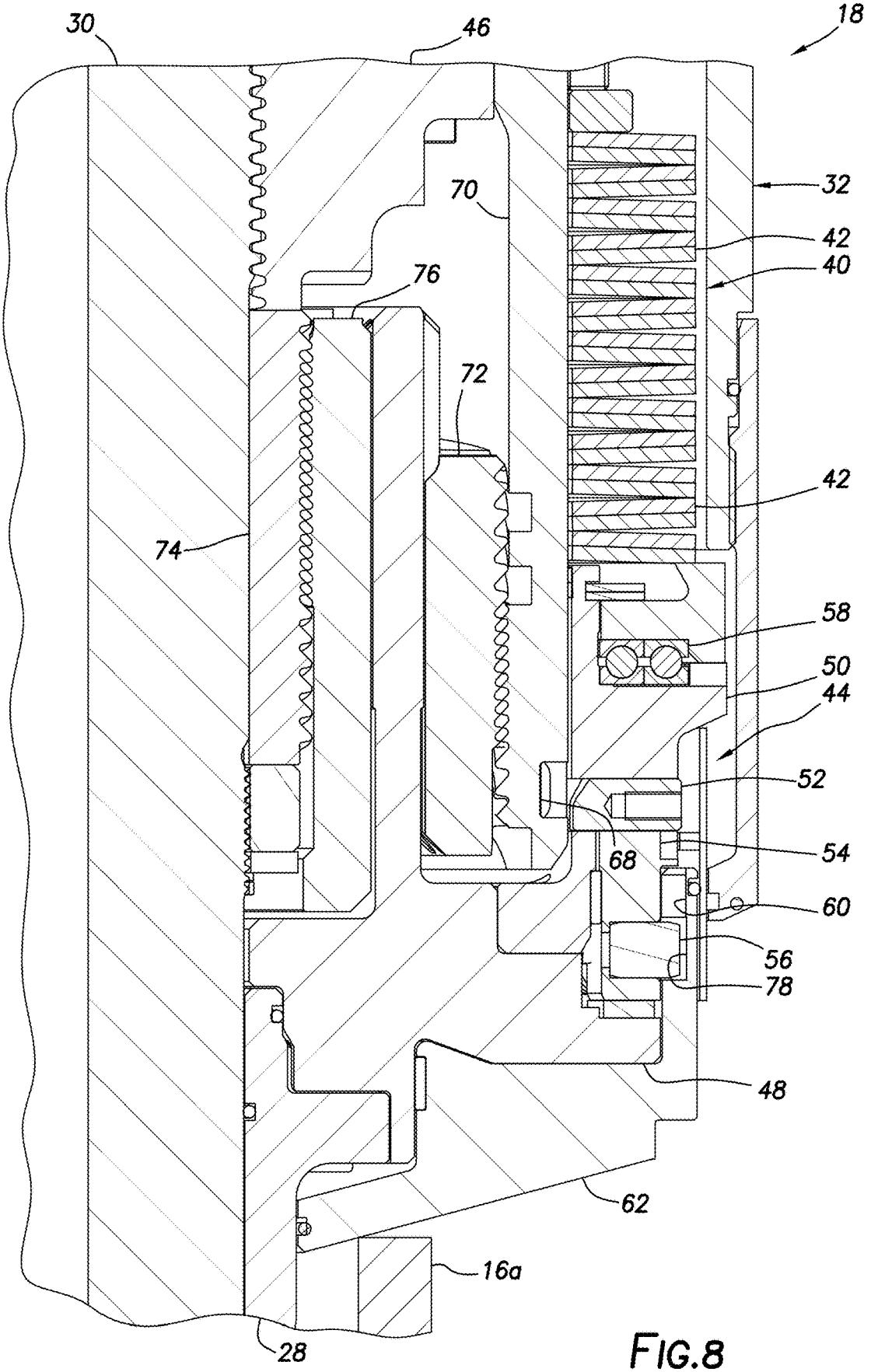
FIG. 8 is a representative cross-sectional view of the portion of the casing running tool in a slips activated configuration.

Referring additionally now to FIG. 8, a representative cross-sectional view of the portion of the casing running tool 18 in a slips activated configuration is depicted. In this configuration, the mandrel 30 has been rotated in a clockwise direction, thereby causing the latch members 52 to be displaced radially outward and out of engagement with the recesses 68. The latch members 52 are displaced radially outward due to clockwise rotation of the mandrel 30 and the internal housing 70, as described more fully below.

As a result, the downwardly biasing force exerted by the compressed springs 42 is now applied to the lower support 48 and the slip cage 28 (via the latch support 50 and bearings 58). This downward biasing of the slip cage 28 causes the slips 26 (see FIG. 3) to be radially outwardly extended into gripping engagement with the internal surface of the casing section 16*a*.

Note that the latch members 52 can be displaced radially outward when the mandrel 30 and internal housing 70 are rotated, since the pins 56 are received in the circumferentially extending slots 78 in the bumper 62, due to the previous vertically downwardly directed load being applied to the tool 18 (see FIG. 6). The pins 56 being received in the slots 78 permits rotation of the synchronization ring 54 which, in turn, permits the radially outward displacement of the latch members 52. Thus, the latch mechanism 44 does not permit the biasing force exerted by the springs 42 to be applied to the lower support 48 and the slip cage 28 (and resulting outward extension of the slips 26), unless the bumper 62 has contacted the upper end of the casing section 16*a* and the vertically downwardly directed load has been applied to the tool 18.

Figure 9:
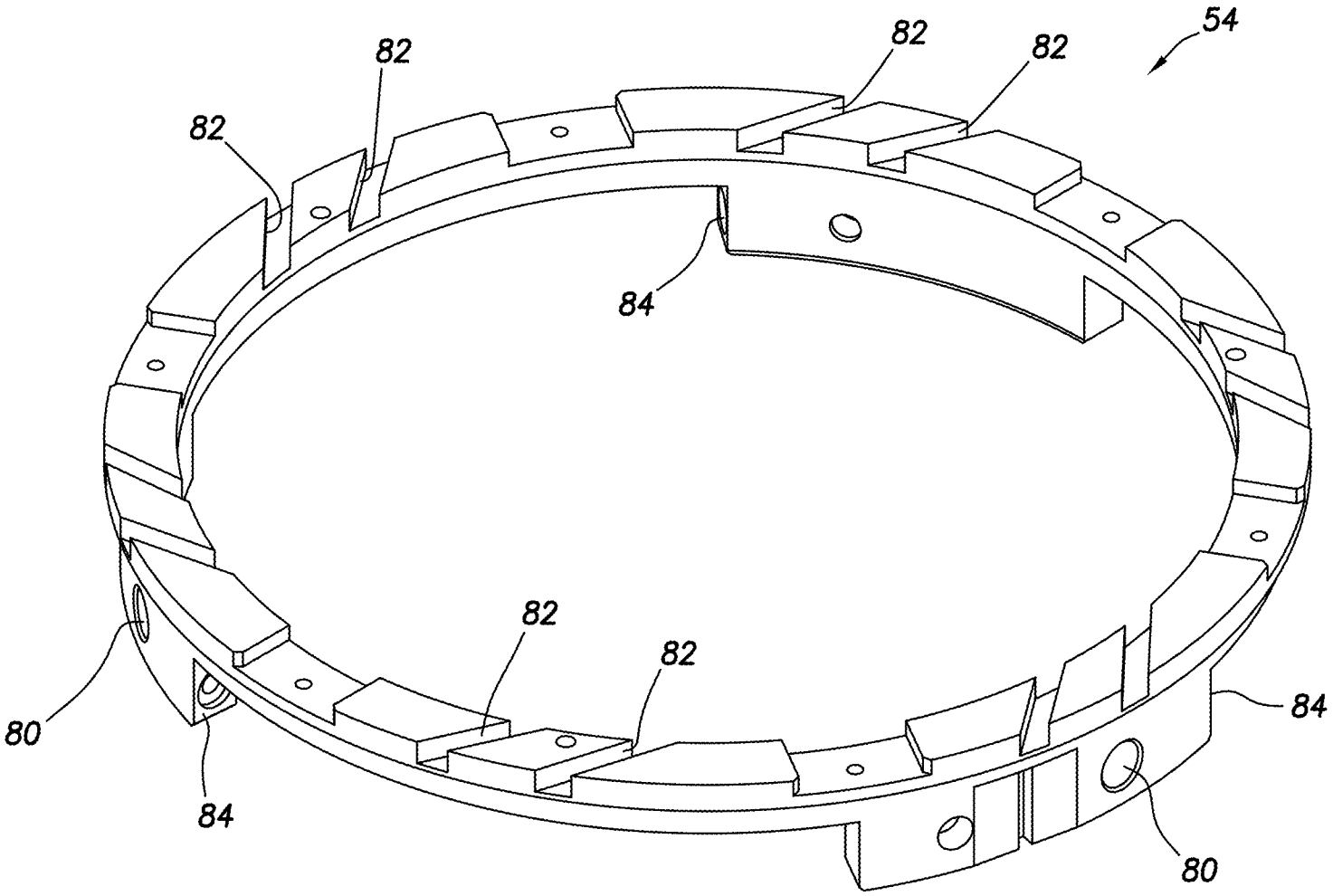
FIG. 9 is a representative perspective view of a synchronization ring of the casing running tool.

Referring additionally now to FIG. 9, a representative perspective view of the synchronization ring 54 is depicted. In this view it may be seen that the synchronization ring 54 includes multiple radially extending openings 80 for receiving the pins 56 (see FIG. 8), multiple radially inclined pairs of slots 82 for receiving the latch members 52 (see FIGS. 10A & B), and circumferentially facing surfaces 84 for application of circumferentially directed biasing forces exerted by the springs 66 (see FIG. 13).

The springs 66 bias the synchronization ring 54 to rotate in a clockwise direction (as viewed from above). The slots 82 are inclined radially, so that the latch members 52 are biased radially inward due to the biasing of the synchronization ring 54 to rotate in the clockwise direction.

Figure 10A:
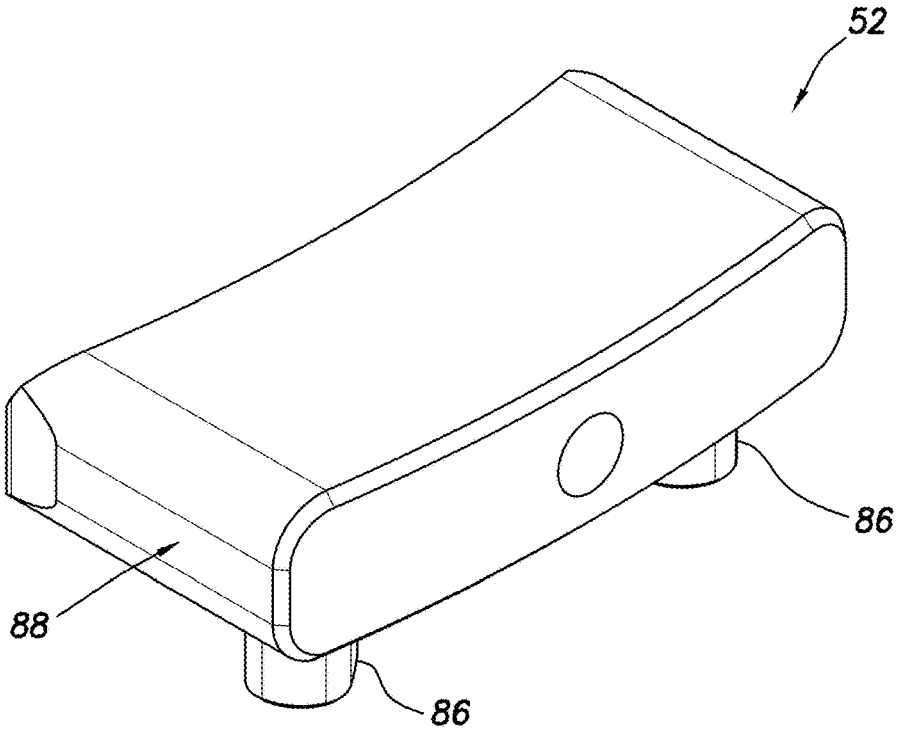
FIGS. 10A & B are representative perspective and side views of a latch member of the casing running tool.
Figure 10B:
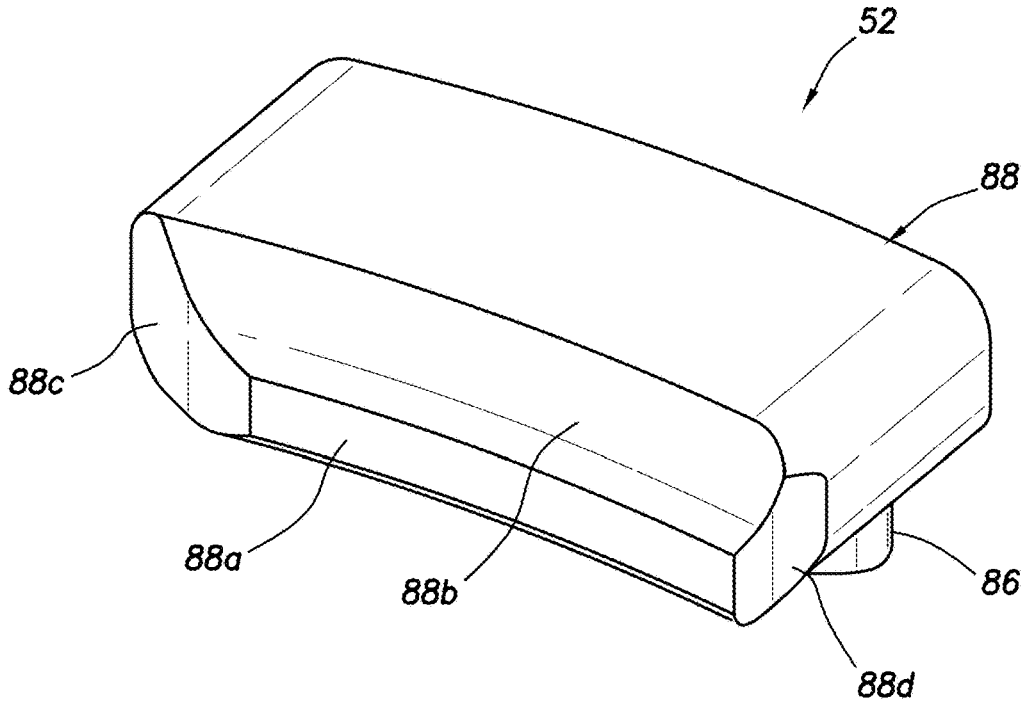

Referring additionally now to FIGS. 10A & B, representative perspective and side views of an example of a latch member 52 are depicted. In these views it may be seen that the latch member 52 includes a pair of spaced apart pins 86 extending downwardly from a body 88. The body 88 includes a radially inwardly facing projection 88*a* configured to cooperatively engage one of the recesses 68 formed in the internal housing 70 (see FIG. 7), and an inclined surface 88*b* configured to deflect the latch member 52 radially outward when the casing running tool 18 is reset (as described more fully below).

The body 88 further includes inclined surfaces 88*c* and 88*d* formed thereon. In other examples, the inclined surfaces 88*c* and 88*d* may not be used. The scope of this disclosure is not limited to any particular features or configuration of the latch member 52.

Figure 19:
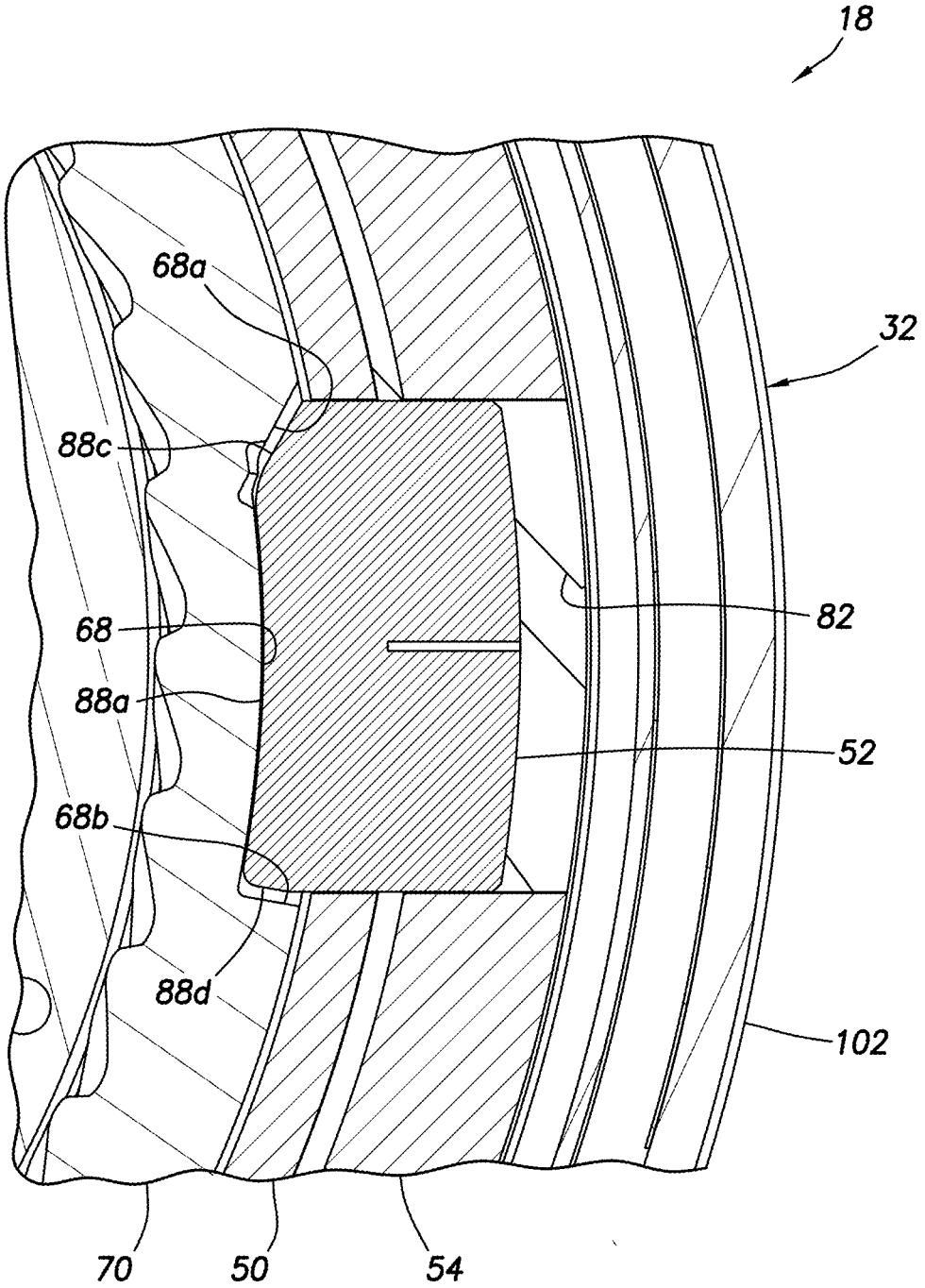
FIG. 19 is a representative cross-sectional view of a portion of the activation section, taken along line 19-19 of FIG. 6.

Referring additionally now to FIG. 19, a cross-sectional view of the latch member 52 in the casing running tool 18, taken along line 19-19 of FIG. 6, is representatively illustrated. In this view the manner in which the latch member 52 is displaced radially outward due to clockwise rotation of the internal housing 70 can be more clearly seen.

As depicted in FIG. 19, each of the recesses 68 in the internal housing 70 has an inclined surface 68*a* formed at one circumferential end of the recess. When the internal housing 70 is rotated clockwise with the mandrel 30, the inclined surface 68*a* will engage the inclined surface 88*c* on the respective latch member 52 and thereby displace the latch member radially outward.

Each recess 68 also includes a surface 68*b* at an opposite circumferential end of the recess that will engage the surface 88*d* of the latch member 52 when the internal housing 70 is rotated in a counter-clockwise direction. The surfaces 68*b*, 88*d* are slightly inclined, so that the latch member 52 does not displace radially outward due to this engagement when the internal housing 70 is rotated counter-clockwise.

Referring again to FIGS. 10A & B, the pins 86 are spaced apart such that they cooperatively engage a pair of the slots 82 in the synchronization ring 54 (see FIG. 9). When the synchronization ring 54 is rotated in a clockwise direction, this engagement between the pins 86 and the slots 82 causes the latch member 52 to be biased radially inward. When the latch member 52 is displaced radially outward as described more fully below, this engagement between the pins 86 and the slots 82 causes the synchronization ring 54 to be rotated in a counter-clockwise direction.

Figure 11:
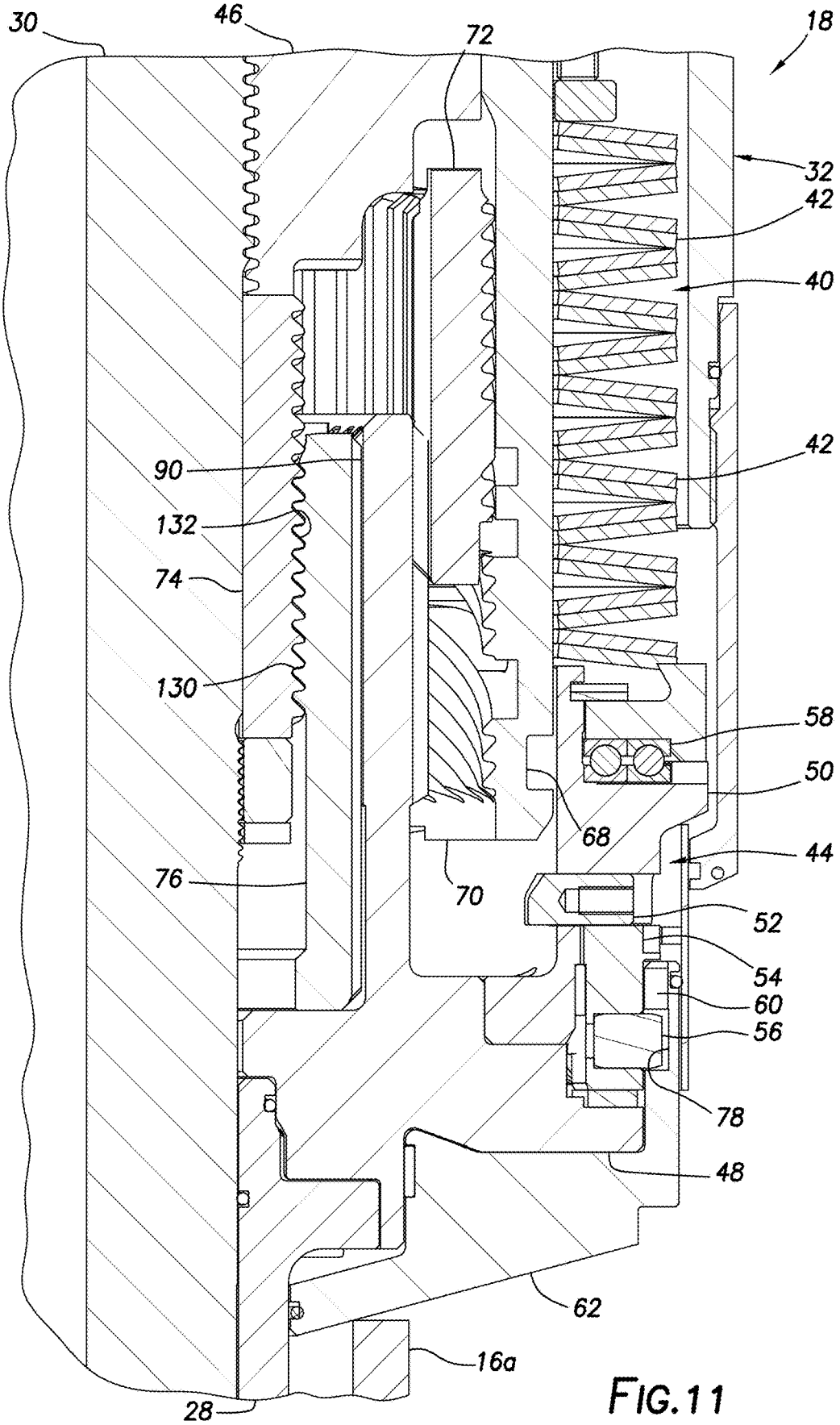
FIG. 11 is a representative cross-sectional view of the portion of the casing running tool in a slips extended configuration.

Referring additionally now to FIG. 11, a representative cross-sectional view of the portion of the casing running tool 18 in a slips extended configuration is depicted. In this view, the mandrel 30 has been rotated clockwise by the top drive 12 in a threaded connection make-up operation, for example, to make-up the upper casing section 16*a* to the lower casing section 16*b* (see FIG. 1).

As described above, the mandrel 30, the threaded sleeve 74 and the internal housing 70 rotate together. In the FIG. 11 example, the clockwise rotation of the threaded sleeve 74 has caused the make-up activation sleeve 76 to displace downwardly, thereby also downwardly displacing the lower support 48 and the slip cage 28. In this manner, the slips 26 (see FIG. 3) are increasingly biased to grip the internal surface of the casing section 16*a*, so that sufficient torque can be transmitted from the top drive 12 to the casing section 16*a* and the make-up operation can be successfully accomplished.

As depicted in FIG. 11, the break-out activation sleeve 72 has displaced upwardly due to the clockwise rotation of the internal housing 70. However, if the internal housing 70 (with the mandrel 30 and threaded sleeve 74) had instead been rotated counter-clockwise, then the break-out activation sleeve 72 would have displaced downwardly, thereby also downwardly displacing the lower support 48 and the slip cage 28. In this manner, the slips 26 would have been increasingly biased to grip the internal surface of the casing section 16*a*, so that sufficient torque could be transmitted from the top drive 12 to the casing section 16*a* and a break-out operation could be successfully accomplished.

Thus, if the mandrel 30, internal housing 70 and threaded sleeve 74 are rotated clockwise after the slips 26 are initially set by application of the set down weight (see FIG. 6) and partial clockwise rotation (see FIG. 8), the make-up activation sleeve 76 is displaced downward to fully set the slips for a make-up operation. If instead the mandrel 30, internal housing 70 and threaded sleeve 74 are rotated counter-clockwise after the slips 26 are initially set by application of the set down weight (see FIG. 6) and partial clockwise rotation (see FIG. 8), the break-out activation sleeve 72 is displaced downward to fully set the slips for a break-out operation.

In a break-out operation, the slips 26 are initially set by application of the set down weight and partial clockwise rotation (10 degrees in this example), in order to release the latch members 52 (see FIG. 8). The mandrel 30 is then lifted somewhat (e.g., by raising the top drive 12), so that the slips 26 begin to grip the internal surface of the casing. The mandrel 30 can then be rotated counter-clockwise to break-out a threaded connection in the casing string.

Note that the break-out activation sleeve 72 and the make-up activation sleeve 76 do not rotate with the mandrel 30, internal housing 70 and threaded sleeve 74. Instead, vertical splines formed on the break-out activation sleeve 70, the make-up activation sleeve 76 and an upper sleeve support portion 90 of the lower support 48 prevent rotation of the make-up and break-out activation sleeves, as described more fully below. The lower support 48 is prevented from rotating when the mandrel 30 is rotated, due to friction between the bumper 62 and the upper end of the casing section 16*a* (since a compressive load is still applied).

Figure 12A:
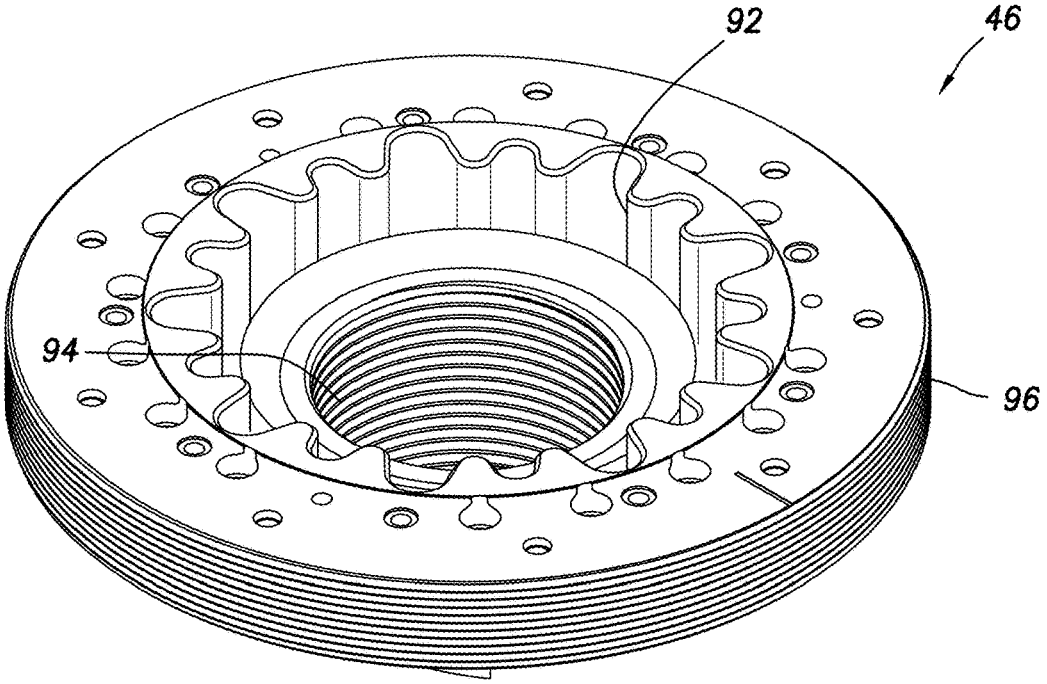
FIGS. 12A & B are representative upper and lower perspective views of an upper support of the casing running tool.

Referring additionally now to FIGS. 12A & B, representative upper and lower perspective views of the upper support 46 are depicted. In these views it can be seen that the upper support 46 includes internal radial undulations 92, internal threads 94, external threads 96 and multiple circumferentially distributed external vertical keyways 98.

The undulations 92 prevent relative rotation between the upper support 46 and an upper seal housing 100 (see FIG. 4) that prevents debris and other undesirable substances from entering the interior of the activation section 32. The internal threads 94 are used to secure the upper support 46 to the mandrel 30. The external threads 96 are used to secure an outer housing assembly 102 (see FIG. 4) to the upper support 46. The keyways 98 are used to prevent relative rotation between the upper support 46 and the internal housing 70, so that the internal housing rotates with the upper support and the mandrel 30.

Figure 13:
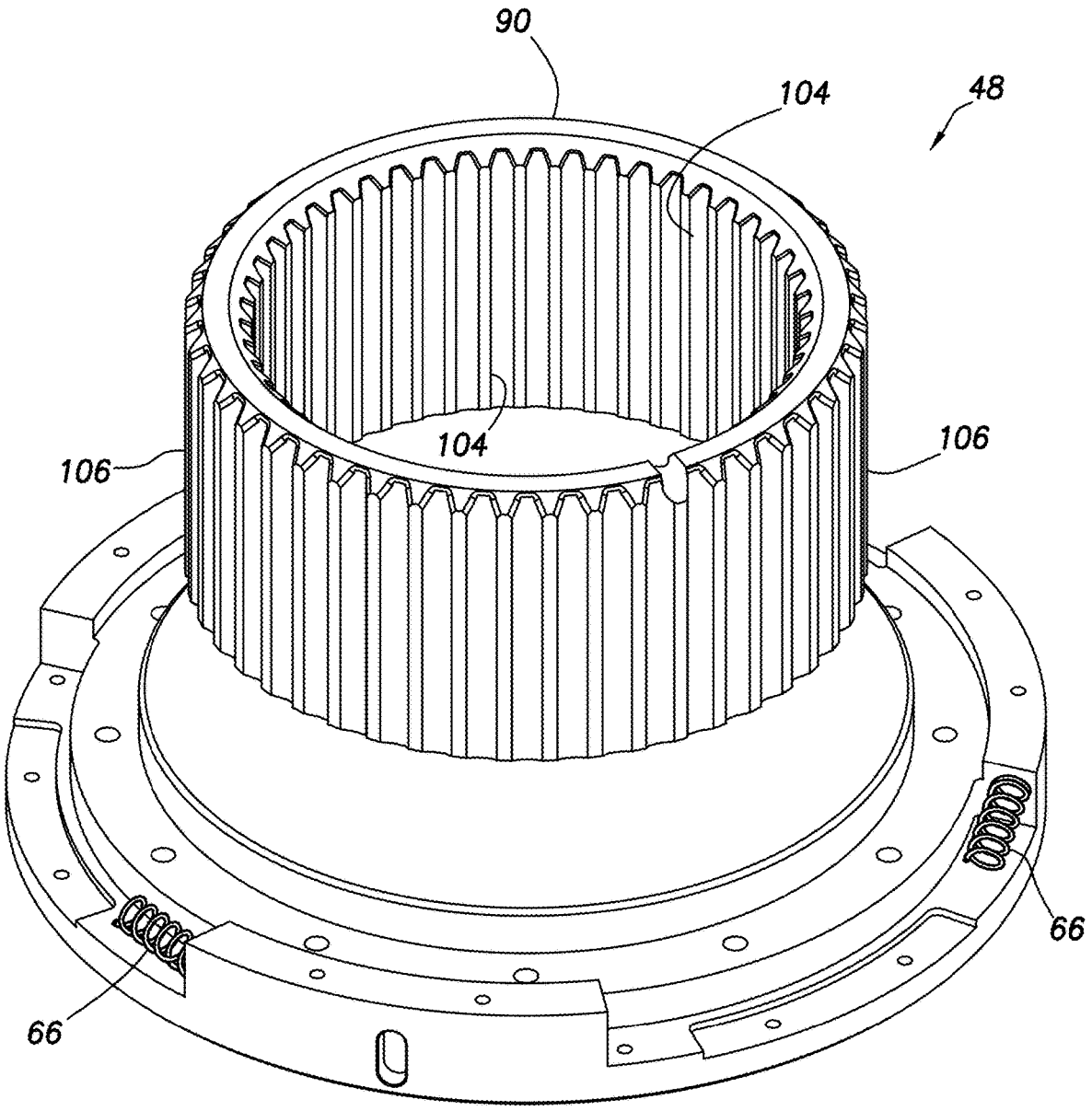
FIG. 13 is a representative perspective view of a lower support of the casing running tool.

Referring additionally now to FIG. 13, a representative perspective view of the lower support 48 is depicted. In this view it may be seen that the sleeve support portion 90 extends upwardly, and has internal longitudinal splines 104 formed therein and external longitudinal splines 106 formed thereon.

The splines 104 engage the splines 112 (see FIG. 16) to prevent relative rotation between the lower support 48 and the make-up activation sleeve 76, while permitting longitudinal displacement of the make-up activation sleeve. The splines 106 engage the splines 114 (see FIG. 15) to prevent relative rotation between the lower support 48 and the break-out activation sleeve 72, while permitting longitudinal displacement of the break-out activation sleeve.

Also depicted in FIG. 13 are the springs 66. As described above, the springs 66 bias the synchronization ring 54 (see FIG. 9) in a clockwise rotational direction.

Figure 14B:
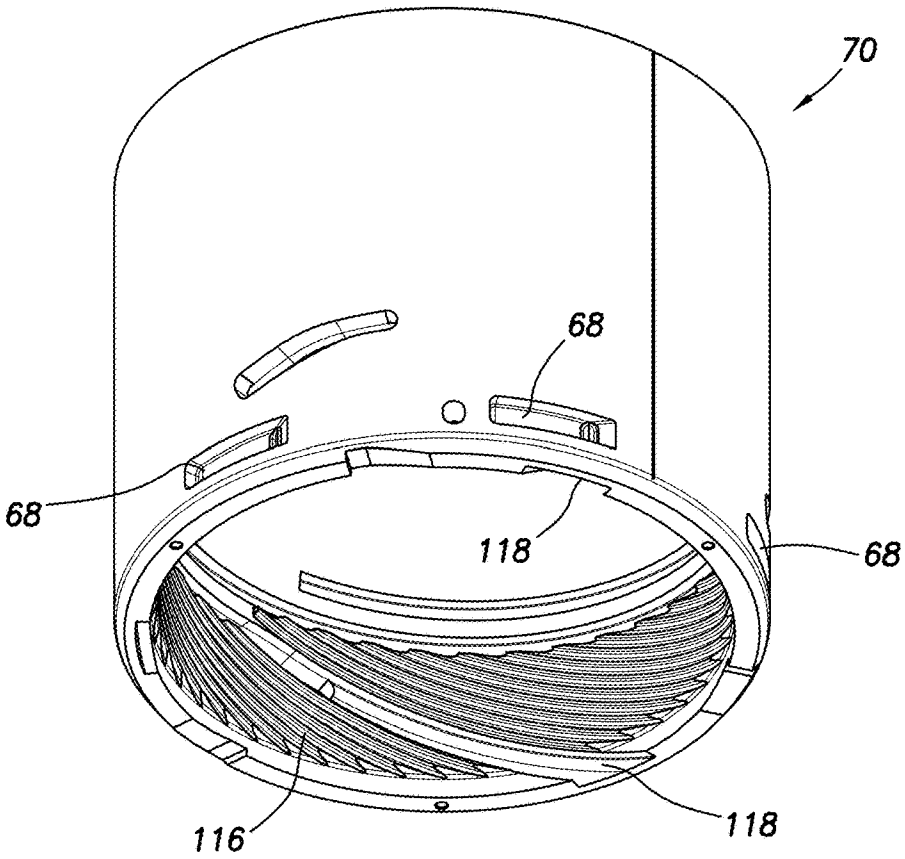
FIGS. 14A & B are representative upper and lower perspective views of an internal housing of the casing running tool.
Figure 14A:
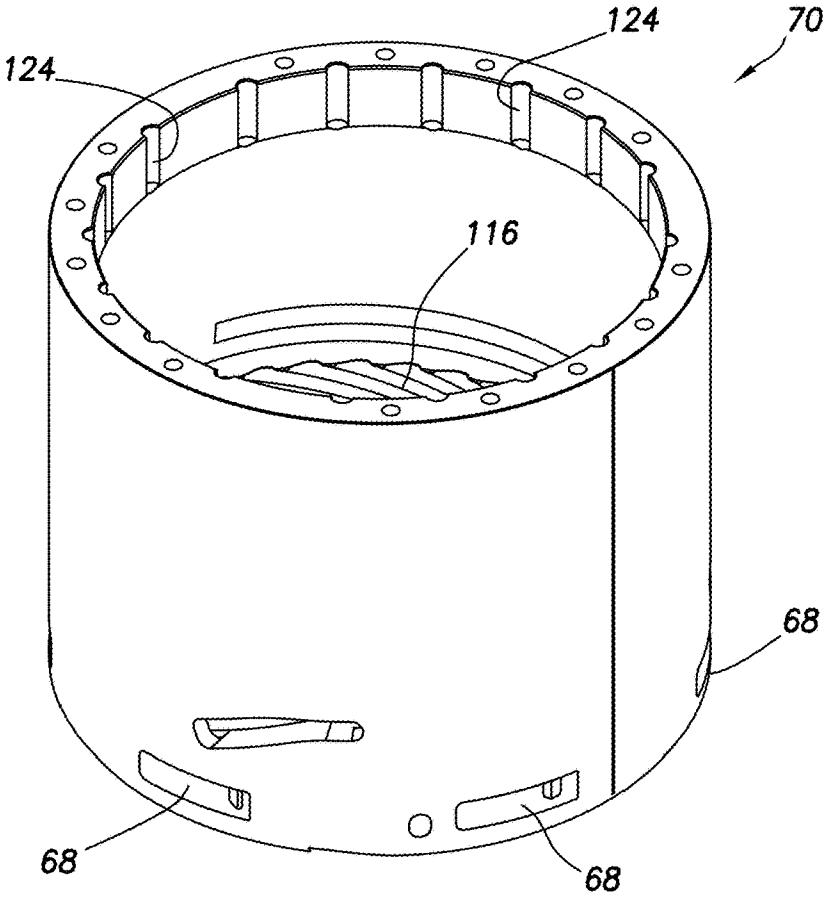

Referring additionally now to FIGS. 14A & B, representative upper and lower perspective views of the internal housing 70 are depicted. In these views it may be seen that the internal housing 70 includes the recesses 68 which receive the latch members 52 therein (see FIG. 6). The internal housing 70 further includes internal threads 116 and internal helical slots 118 for cooperative engagement with respective external threads 120 and keys 122 on the break-out activation sleeve 72 (see FIG. 15).

Figure 12B:
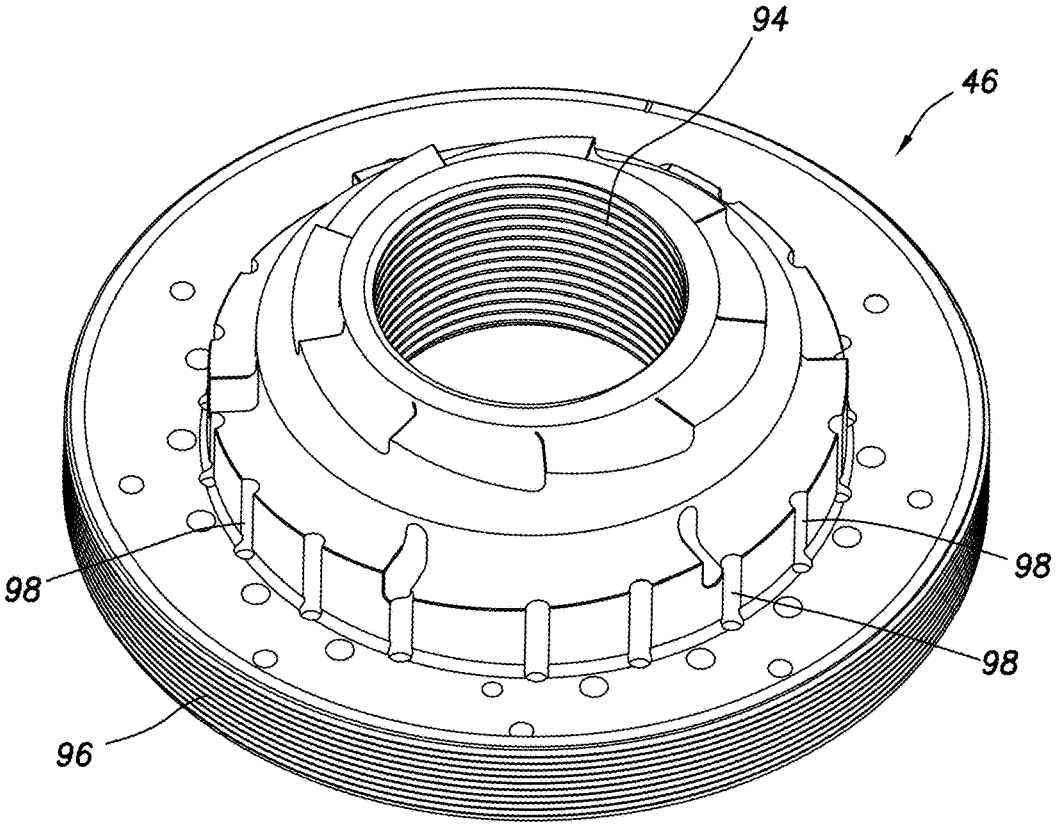

In addition, internal longitudinal keyways 124 are formed in an upper portion of the internal housing 70. Keys (not shown) are engaged between the keyways 124 in the internal housing 70 and the external keyways 98 formed on the upper support 46 (see FIG. 12B) to thereby prevent relative rotation between the upper support and the internal housing 70.

Figure 15:
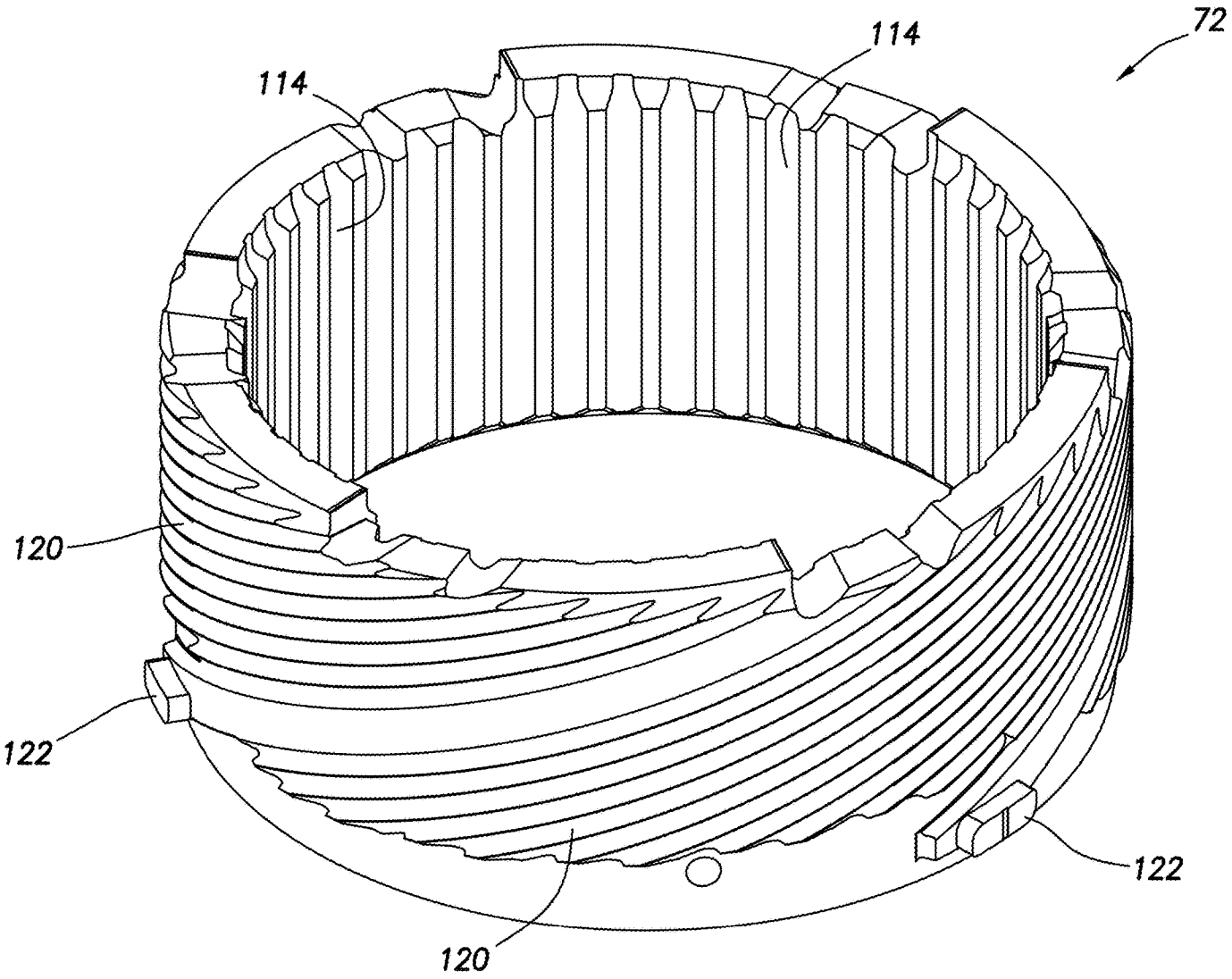
FIG. 15 is a representative perspective view of a break-out activation sleeve of the casing running tool.

Referring additionally now to FIG. 15, a representative perspective view of the break-out activation sleeve 72 is depicted. In this view it may be seen that the break-out activation sleeve 72 includes the external threads 120 and keys 122 for engagement with the internal threads 116 and helical slots 118 in the internal housing 70 (see FIG. 14B). The break-out activation sleeve 72 also includes the internal longitudinal splines 114 for engagement with the external splines 106 on the sleeve support portion 90 of the lower support 48 (see FIG. 13).

Figure 16:
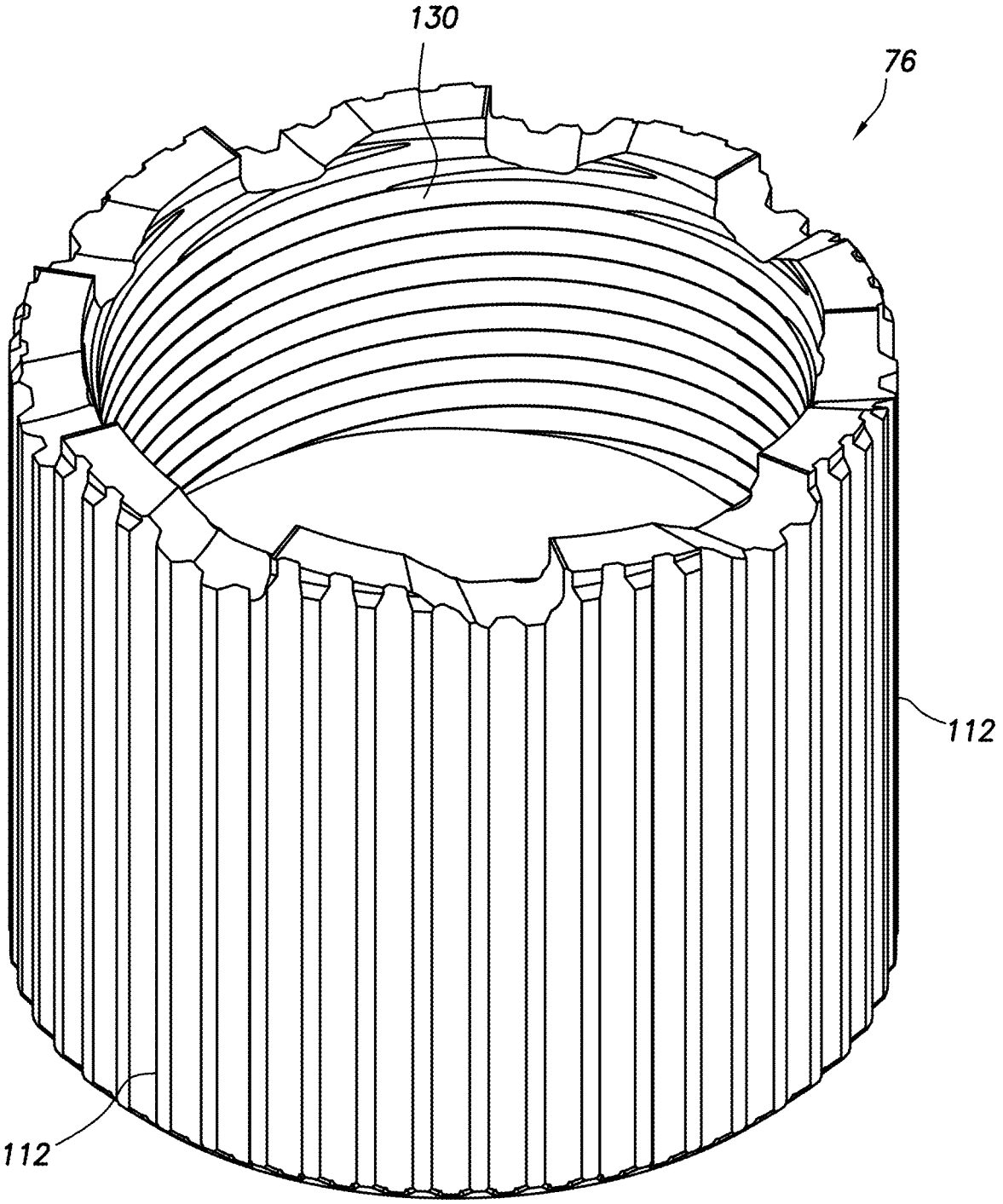
FIG. 16 is a representative perspective view of a make-up activation sleeve of the casing running tool.

Referring additionally now to FIG. 16, a representative perspective view of the make-up activation sleeve 76 is depicted. In this view, it may be seen that the make-up activation sleeve 76 includes the external splines 112 for engagement with the splines 104 in the sleeve support portion 90 of the lower support 48 (see FIG. 13). The make-up activation sleeve 76 also includes internal threads 130 for engagement with external threads 132 formed on the threaded sleeve 74 (see FIG. 11).

Figure 17:
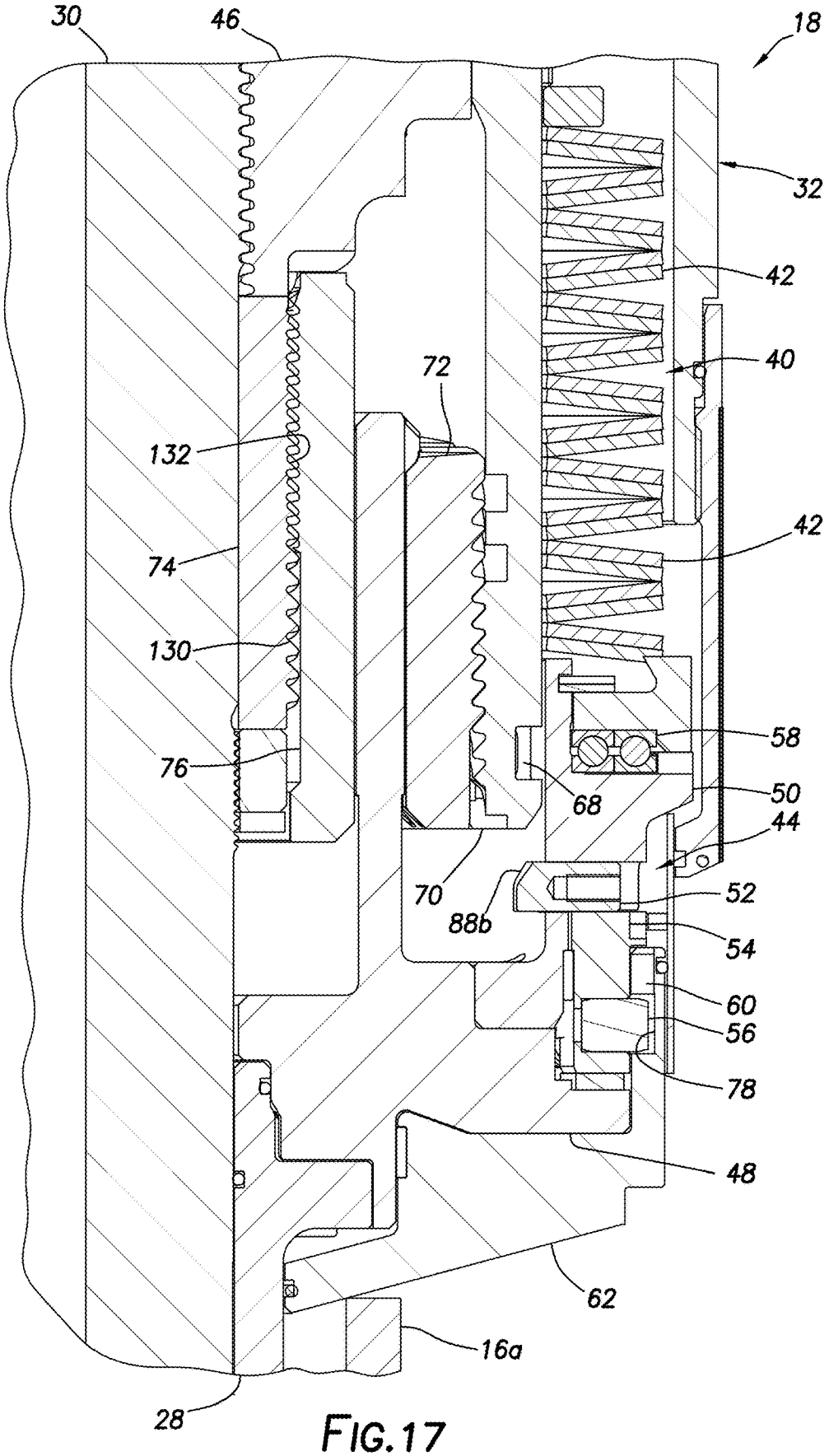
FIG. 17 is a representative cross-sectional view of the portion of the casing running tool in a partially reset configuration.

Referring additionally now to FIG. 17, a representative cross-sectional view of the portion of the casing running tool 18 in a partially reset configuration is depicted. In the partially reset configuration, a threaded connection make-up or break-out operation has been completed, and the casing running tool 18 is prepared for returning to the initial configuration of FIG. 5.

If a make-up operation was performed, in which the mandrel 30, threaded sleeve 74 and internal housing 70 were rotated clockwise to thereby cause the make-up activation sleeve 76 to displace downwardly to set the slips 26, then after the make-up operation the mandrel, threaded sleeve and internal housing are rotated counter-clockwise to displace the make-up activation sleeve upward to its initial position relative to the threaded sleeve.

If a break-out operation was performed, in which the mandrel 30, threaded sleeve 74 and internal housing 70 were rotated counter-clockwise to thereby cause the break-out activation sleeve 72 to displace downwardly to set the slips 26, then after the break-out operation the mandrel, threaded sleeve and internal housing are rotated clockwise to displace the break-out activation sleeve upward to its initial position relative to the internal housing.

With the casing running tool 18 in the partially reset configuration of FIG. 17, the tool can be returned to its locked configuration of FIG. 6 by applying set down weight. For example, a vertically downward load can be applied to the casing running tool 18 using the top drive 12.

The bumper 62 remains abutted against the casing section 16*a* when the vertical load is applied, and so the bumper, the lower support 48 and the latch assembly 44 remain stationary as the vertical load is applied. However, the mandrel 30, threaded sleeve 74, upper support 46, internal housing 70, make-up activation sleeve 76, break-out activation sleeve 72 and the outer housing assembly 102 will displace downward as the vertical load is applied. This will cause the biasing device 40 to be compressed.

In addition, the inclined surfaces 88*b* on the latch members 52 will contact a lower end of the internal housing 70, thereby causing the latch members to displace radially outward, and then displace radially inward into engagement with the recesses 68. This will prevent the biasing force exerted by the compressed springs 42 from being applied to the lower support 48 and slip cage 28 until it is desired to perform another make-up or break-out operation with the casing running tool 18.

After the vertical load is applied and the latch assembly 44 is again engaged with the recesses 68 of the internal housing 70, the casing running tool 18 can be withdrawn from the casing section 16*a*. When the casing running tool 18 is withdrawn, the previously applied vertical load is relieved, thereby allowing the springs 64 (see FIG. 4) to displace the bumper 62 back to its initial position. In this position, the pins 56 will again be received in the vertical slots 60 in the bumper 62.

With the casing running tool 18 withdrawn from the casing section 16*a* and the bumper 62 returned to its initial position, the casing running tool will be fully reset to the FIGS. 4 & 5 initial configuration. The casing running tool 18 is then ready for use in another make-up or break-out operation.

Referring additionally now to FIGS. 18A-E, representative elevational views of the activation section 32 of the casing running tool 18 in the initial, bumper compressed, slips activated, slips extended and partially reset configurations are depicted. In these views the manner in which the visual indicators 34*a-c* are useful to indicate the configurations of the activation section 32 can be seen.

Figure 18A:
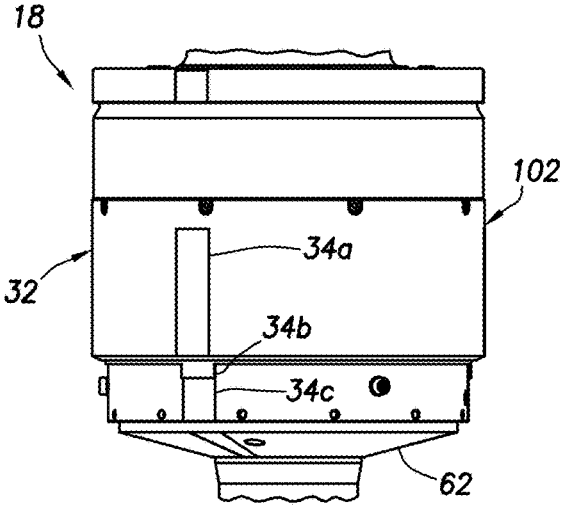
FIGS. 18A-E are representative elevational views of the activation section of the casing running tool in the initial, bumper compressed, slips activated, slips extended and partially reset configurations.

The activation section 32 is depicted in the FIG. 5 initial configuration in FIG. 18A. The activation section 32 is depicted in the FIG. 6 bumper compressed configuration in FIG. 18B. The activation section 32 is depicted in the FIG. 8 slips activated configuration in FIG. 18C. The activation section 32 is depicted in the FIG. 11 slips extended configuration in FIG. 18D. The activation section 32 is depicted in the FIG. 18 partially reset configuration in FIG. 18E.

The visual indicator 34*a* is secured to the outer housing assembly 102 of the activation section 32. The visual indicator 34*b* is secured to the synchronization ring 54 (see FIG. 5). The visual indicator 34*c* is secured to the bumper 62.

In this example, the visual indicators 34*a,c* comprise vertical lines and preferably have an easily distinguished color. The visual indicator 34*b* comprises a vertical tab extending downward from within the outer housing assembly 102.

In the FIG. 18A initial configuration, the visual indicators 34*a-c* are all vertically aligned. A certain length of the visual indicator 34*c* is exposed below the visual indicator 34*b*.

Figure 18B:
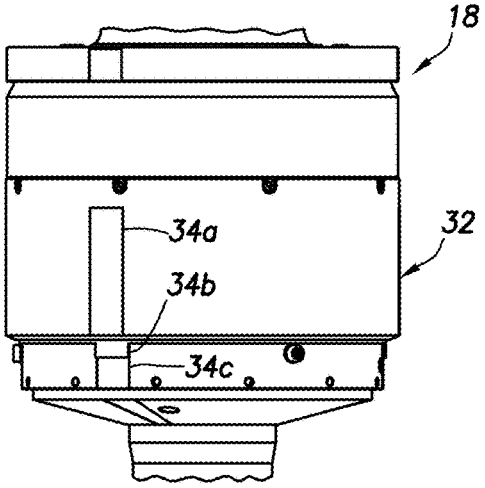

In the FIG. 18B bumper compressed configuration, the visual indicators 34*a-c* are still vertically aligned, but the exposed length of visual indicator 34*c* is shortened. This shortened length of the visual indicator 34*c* indicates that the bumper 62 has been compressed against the casing section 16*a* (see FIG. 6).

Figure 18C:
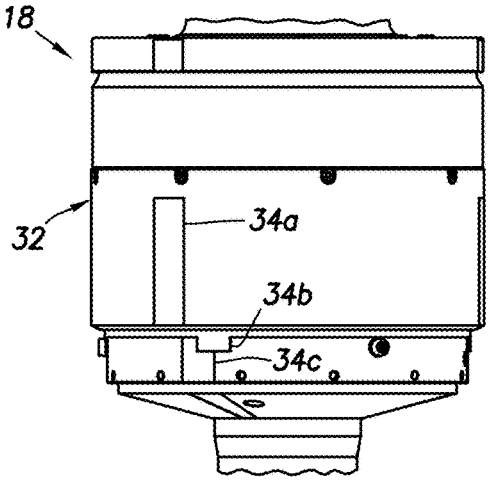

In the FIG. 18C slips activated configuration, the visual indicator 34*a* is no longer vertically aligned with the other visual indicators 34*b,c*. Instead, the visual indicator 34*a* is rotated somewhat in a clockwise direction (about 10 degrees in this example) relative to the visual indicators 34*b,c*. This rotation of the visual indicator 34*a*, while the visual indicator 34*c* remains in its FIG. 18B position, indicates that the slips 26 have been activated by allowing the biasing force exerted by the biasing device 40 to be applied to the lower support 48 and the slip cage 28. The visual indicator 34*b* is rotated somewhat counter-clockwise (about 5 degrees in this example) to indicate that the latch members 52 are released from engagement with the recesses 68.

Figure 18D:
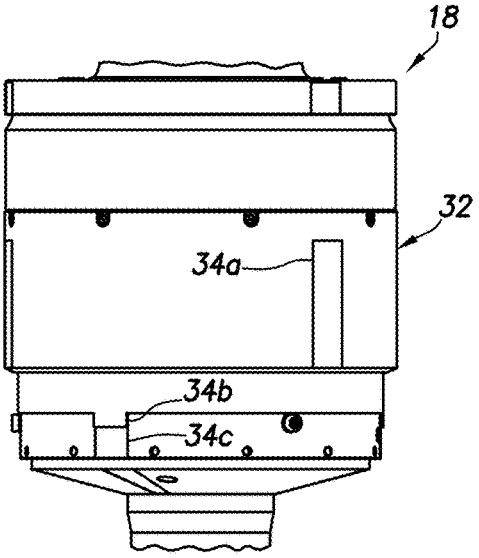

In the FIG. 18D slips extended configuration, the visual indicator 34*a* is further rotated relative to the visual indicators 34*b,c*. In addition, the visual indicators 34*b,c* are displaced downward relative to the outer housing assembly 102. These positions indicate that clockwise or counter-clockwise rotation has been applied to the casing running tool 18 in a respective make-up or break-out operation to thereby fully extend the slips 26 into gripping engagement with the internal surface of the casing section 16*a*. The visual indicator 34*b* is again aligned with the other indicators 34*a,c*, indicating that the latch members 52 are now below the internal housing 70 and extended radially inward (see FIG. 11).

Figure 18E:
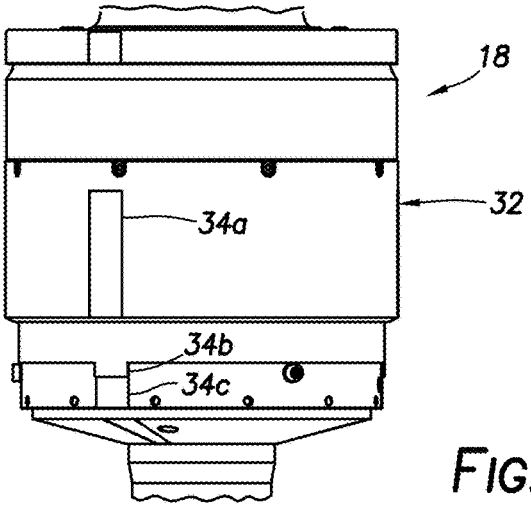

In the FIG. 18E partially reset configuration, the visual indicators 34*a-c* are again vertically aligned, thereby indicating that clockwise or counter-clockwise rotation has been applied to the casing running tool 18 to return the make-up and break-out activation sleeves 76, 72 to their initial positions relative to the threaded sleeve 74 and the internal housing 70 (see FIG. 17). Set down weight can now be applied to the casing running tool 18 to return it to the FIGS. 5 & 18A initial configuration.

Figure 20:
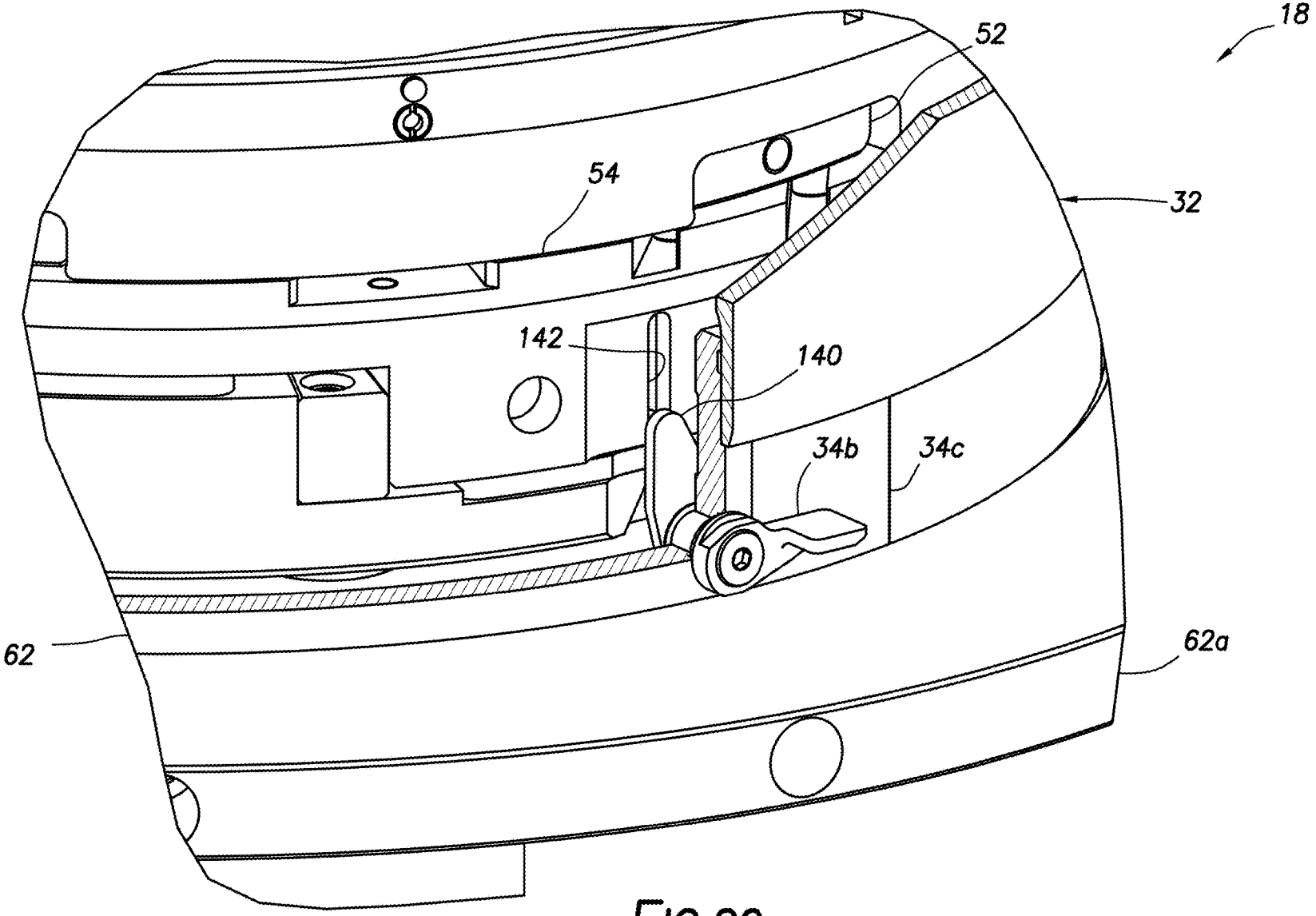
FIG. 20 is a representative perspective view of another example of the casing running tool in the initial configuration.

Referring additionally now to FIG. 20, a perspective view of a portion of another example of the casing running tool 18 is representatively illustrated. In this view, the casing running tool 18 is in the initial configuration (similar to the FIG. 5 initial configuration described above).

Note that bumper 62 in the FIG. 20 example has a radially outwardly extended flange 62*a*. In addition, the visual indicator 34*b* is in the form of a rotationally mounted tab.

The visual indicator 34*b* is connected to an arm 140 that engages a vertical slot 142 formed in the synchronization ring 54. When the synchronization ring 54 rotates relative to the bumper 62, this will cause the visual indicator 34*b* to rotate, which will indicate to an observer whether the latch members 52 are in their radially inwardly or outwardly displaced positions.

In the initial configuration of FIG. 20, the bumper 62 has not yet been compressed against the upper end of the casing section 16*a*. The latch members 52 are engaged with the recesses 68 in the internal housing 70, and so the biasing force exerted by the springs 42 cannot be applied to the slip cage 28 to set the slips 26. This is indicated by the visual indicator 34*b* being in a generally horizontal orientation.

Figure 21:
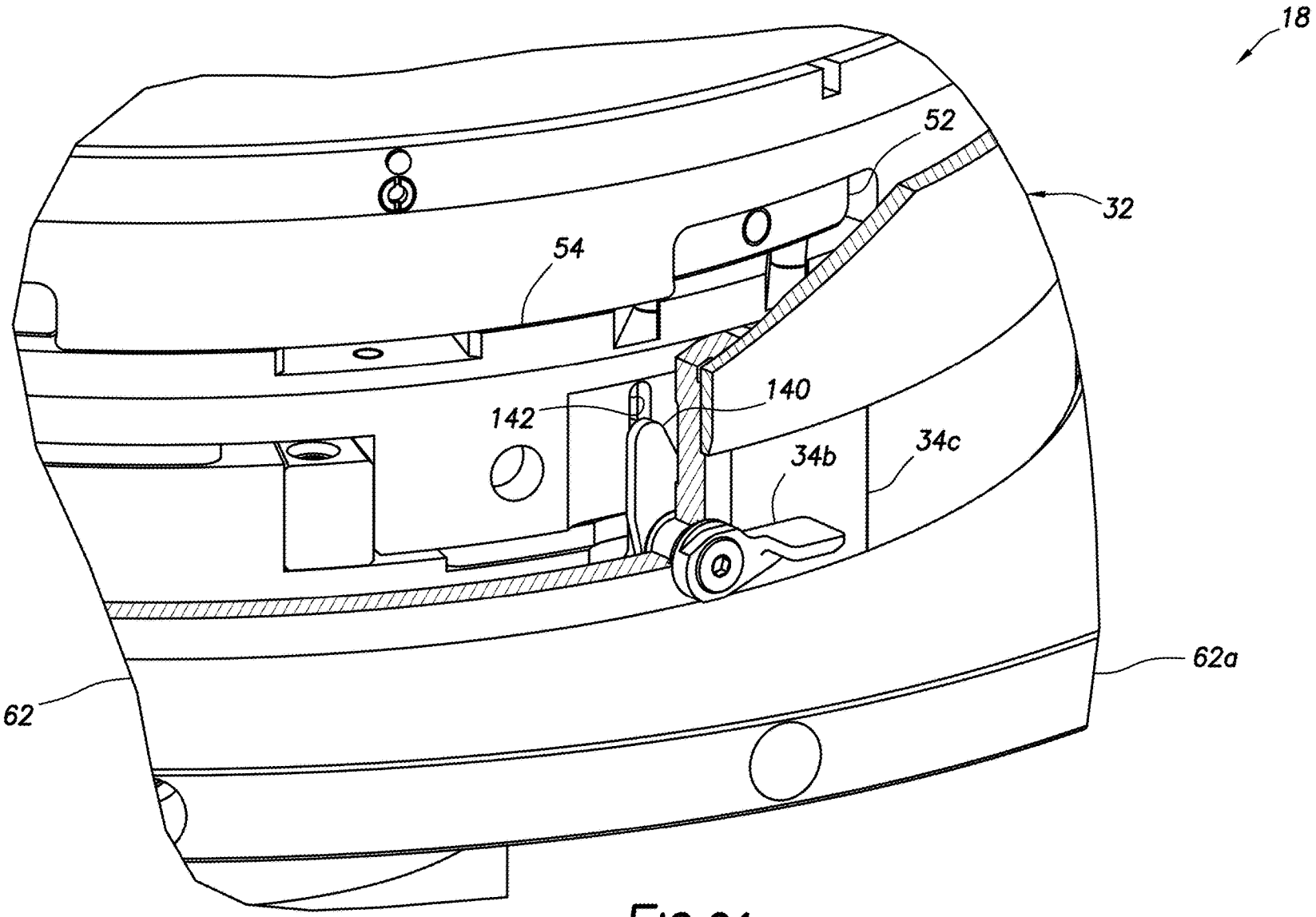
FIG. 21 is a representative perspective view of the FIG. 20 casing running tool example in the bumper compressed configuration.

Referring additionally now to FIG. 21, a perspective view of the portion of the casing running tool 18 is representatively illustrated. In this view, the casing running tool 18 is in the bumper compressed configuration (similar to the FIG. 6 bumper compressed configuration described above).

As depicted in FIG. 21, the compressive load has been applied to the casing running tool 18, so that the synchronization ring 54 (and other internal components of the activation section 32) are displaced downward relative to the bumper 62. As a result, the slot 142 is displaced downward relative to the arm 140 of the visual indicator 34*b*.

The visual indicator 34*b* remains in its generally horizontal orientation. The latch members 52 remain engaged with the recesses 68 in the internal housing 70.

Figure 22:
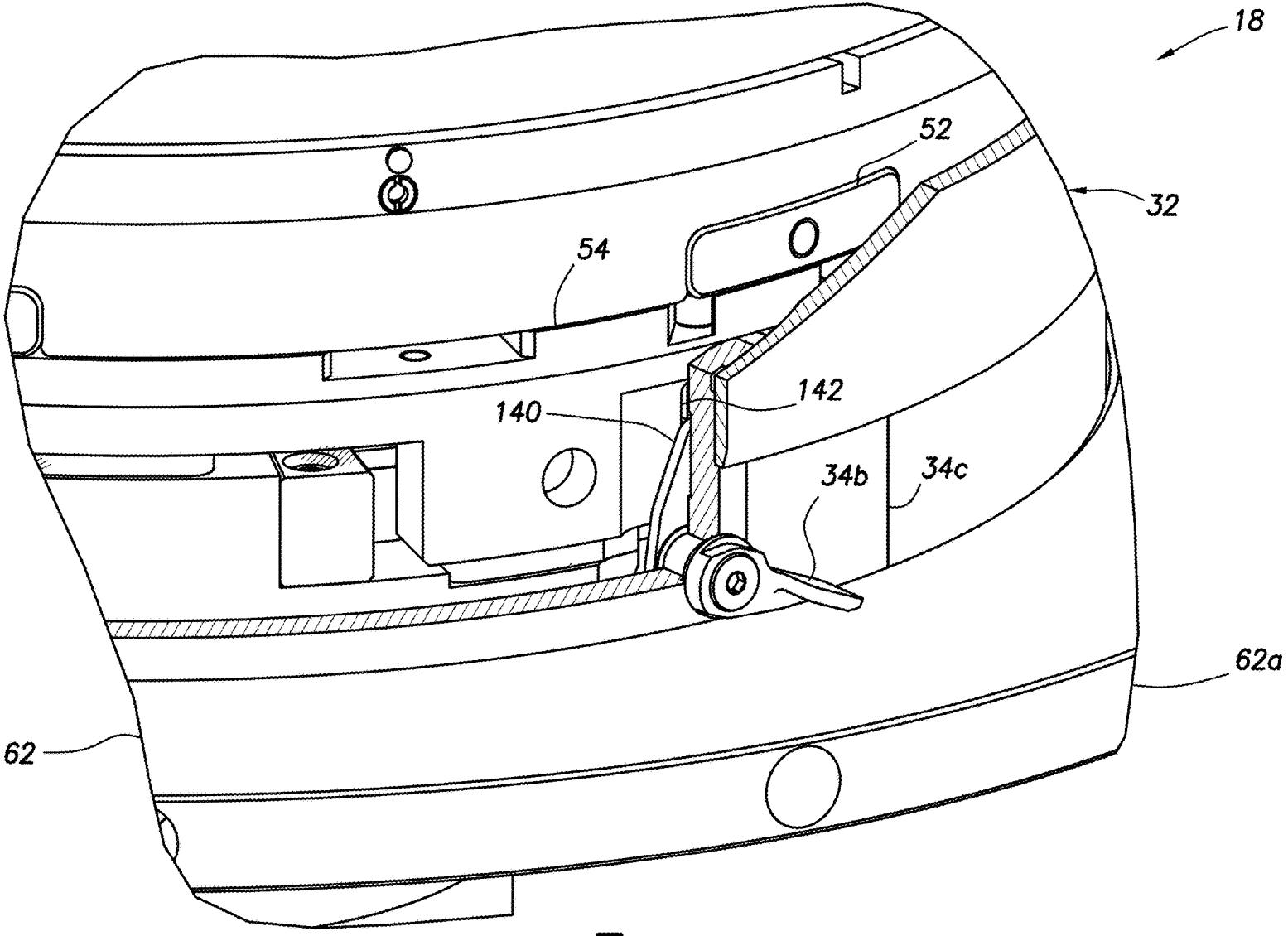
FIG. 22 is a representative perspective view of the FIG. 20 casing running tool example in the slips activated configuration.

Referring additionally now to FIG. 22, a perspective view of the portion of the casing running tool 18 is representatively illustrated. In this view, the casing running tool 18 is in the slips activated configuration (similar to the FIG. 8 slips activated configuration).

As depicted in FIG. 22, the synchronization ring 54 (and other internal components of the activation section 32) have been rotated counter-clockwise relative to the bumper 62 (e.g., in a break-out operation) while the compressive load remains applied from the bumper to the upper end of the casing section 16*a*. The rotation of the synchronization ring 54 relative to the bumper 62 causes the arm 140 and the visual indicator 34*b* to rotate clockwise.

Thus, the visual indicator 34*b* is now in a downwardly inclined orientation. This indicates to an observer that the latch members 52 are now in their radially outwardly displaced positions. The visual indicator 34*b* will rotate counter-clockwise to its generally horizontal orientation when the latch members 52 displace to their radially inward positions engaged with the recesses 68.

It may now be fully appreciated that the above disclosure provides significant advancements to the art of designing, constructing and operating casing running tools. In examples described above, the casing running tool 18 can be operated to make-up or break-out threaded connections by manipulation of the top drive 12 connected thereto, without a need for any externally supplied hydraulic, pneumatic or electrical power. Operation of the casing running tool 18 does not require the presence of any personnel on the rig floor 23. The casing running tool 18 provides for safe, rapid and efficient casing running and pulling operations.

The above disclosure provides to the art a method of handling a casing section 16*a* for use with a subterranean well. In one example, the method can include: rotating a mandrel 30 of a casing running tool 18 in a first rotational direction, thereby making-up or breaking-out a threaded connection; then rotating the mandrel 30 in a second rotational direction opposite to the first rotational direction; and then applying a longitudinally compressive load to the casing running tool 18, thereby retracting slips 26 of the casing running tool 18 out of gripping engagement with the casing section 16*a*.

The method may include outwardly extending the slips 26 into gripping engagement with the casing section 16*a* prior to the step of rotating the mandrel 30 in the first rotational direction. The longitudinally compressive load applying step may include retracting the slips 26 out of gripping engagement with an internal surface of the casing section 16*a*.

The longitudinally compressive load applying step may include engaging a latch member 52 with a recess 68 formed in an internal housing 70 of the casing running tool 18. The internal housing 70 may rotate with the mandrel 30 in both of the step of rotating the mandrel 30 in the first rotational direction and the step of rotating the mandrel 30 in the second rotational direction.

The longitudinally compressive load applying step may include compressing a biasing device 40. A biasing force exerted by the biasing device 40 may be applied to the slips 26 in the step of rotating the mandrel 30 in the first rotational direction.

The casing running tool 18 may include a make-up activation sleeve 76 that is displaced in a first longitudinal direction in the step of rotating the mandrel 30 in the first rotational direction. The make-up activation sleeve 76 may be displaced in a second longitudinal direction opposite to the first longitudinal direction in the step of rotating the mandrel 30 in the second rotational direction.

The casing running tool 18 may include a break-out activation sleeve 72 that is displaced in the second longitudinal direction in the step of rotating the mandrel 30 in the first rotational direction. The break-out activation sleeve 72 may be displaced in the first longitudinal direction in the step of rotating the mandrel 30 in the second rotational direction.

The above disclosure also provides to the art a casing running tool 18 for use with a subterranean well. In one example, the casing running tool 18 can include a tubular mandrel 30, slips 26 configured to grip a casing section 16*a* in response to rotation of the mandrel 30, a make-up activation sleeve 76 configured to displace in a first longitudinal direction in response to rotation of the mandrel 30 in a first rotational direction, and a break-out activation sleeve 72 configured to displace in a second longitudinal direction opposite to the first longitudinal direction in response to the rotation of the mandrel 30 in the first rotational direction.

The make-up activation sleeve 76 may be further configured to displace in the second longitudinal direction in response to rotation of the mandrel 30 in a second rotational direction opposite to the first rotational direction. The break-out activation sleeve 72 may be further configured to displace in the first longitudinal direction in response to rotation of the mandrel 30 in the second rotational direction.

The casing running tool 18 may include a support 48 secured to a slip cage 28 configured to displace the slips 26 between outwardly extended and inwardly retracted positions. Relative rotation may be prevented between the support 48 and the make-up activation sleeve 76. Relative rotation may be prevented between the support 48 and the break-out activation sleeve 72.

Relative longitudinal displacement may be permitted between the support 48 and the make-up activation sleeve 76. Relative longitudinal displacement may be permitted between the support 48 and the break-out activation sleeve 72.

The casing running tool 18 may include a biasing device 40 and a latch mechanism 44. The latch mechanism 44 may be configured to prevent a biasing force exerted by the biasing device 40 from being applied to the slips 26 when the latch mechanism 44 is engaged with an internal housing 70 of the casing running tool 18.

The biasing device 40 may be configured to compress in response to a longitudinal compressive load applied to the casing running tool 18. The latch mechanism 44 may be configured to engage the internal housing 70 in response to the longitudinal compressive load applied to the casing running tool 18.

The latch mechanism 44 may include a synchronization ring 54 configured to prevent disengagement of a latch member 52 from the internal housing 70 when a longitudinally compressive load is not applied to the casing running tool 18. The synchronization ring 54 also ensures that all latch members 52 displace equally (e.g., prevent sticking of one latch member) to have a reliable signal for "clamp" and "released" configurations.

A recess 68 formed in the internal housing 70 may be configured to displace a latch member 52 of the latch mechanism 44 out of engagement with the recess 68 in response to rotation of the internal housing 70.

Although various examples have been described above, with each example having certain features, it should be understood that it is not necessary for a particular feature of one example to be used exclusively with that example. Instead, any of the features described above and/or depicted in the drawings can be combined with any of the examples, in addition to or in substitution for any of the other features of those examples. One example's features are not mutually exclusive to another example's features. Instead, the scope of this disclosure encompasses any combination of any of the features.

Although each example described above includes a certain combination of features, it should be understood that it is not necessary for all features of an example to be used. Instead, any of the features described above can be used, without any other particular feature or features also being used.

It should be understood that the various embodiments described herein may be utilized in various orientations, such as inclined, inverted, horizontal, vertical, etc., and in various configurations, without departing from the principles of this disclosure. The embodiments are described merely as examples of useful applications of the principles of the disclosure, which is not limited to any specific details of these embodiments.

In the above description of the representative examples, directional terms (such as "above," "below," "upper," "lower," "upward," "downward," etc.) are used for convenience in referring to the accompanying drawings. However, it should be clearly understood that the scope of this disclosure is not limited to any particular directions described herein.

The terms "including," "includes," "comprising," "comprises," and similar terms are used in a non-limiting sense in this specification. For example, if a system, method, apparatus, device, etc., is described as "including" a certain feature or element, the system, method, apparatus, device, etc., can include that feature or element, and can also include other features or elements. Similarly, the term "comprises" is considered to mean "comprises, but is not limited to."

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of this disclosure. For example, structures disclosed as being separately formed can, in other examples, be integrally formed and vice versa. Accordingly, the foregoing detailed description is to be clearly understood as being given by way of illustration and example only, the spirit and scope of the invention being limited solely by the appended claims and their equivalents.

What is claimed is:

1. A method of handling a casing section for use with a subterranean well, the method comprising:

rotating a mandrel of a casing running tool in a first rotational direction, thereby making-up or breaking-out a threaded connection;

then rotating the mandrel in a second rotational direction opposite to the first rotational direction;

while rotating the mandrel in the second rotational direction, applying a longitudinally compressive load to the casing running tool, thereby retracting slips of the casing running tool out of gripping engagement with the casing section, in which the longitudinally compressive load applying comprises engaging a latch member with a recess formed in an internal housing of the casing running tool; and rotating a visual indicator of the casing running tool in response to the latch member engaging the recess.

2. The method of claim 1, further comprising outwardly extending the slips into gripping engagement with the casing section prior to the rotating the mandrel in the first rotational direction.

3. The method of claim 1, in which the longitudinally compressive load applying comprises retracting the slips out of gripping engagement with an internal surface of the casing section.

4. The method of claim 1, in which the internal housing rotates with the mandrel in both of the rotating the mandrel in the first rotational direction and the rotating the mandrel in the second rotational direction.

5. The method of claim 1, in which the longitudinally compressive load applying comprises compressing a biasing device, and in which a biasing force exerted by the biasing device is applied to the slips in the rotating the mandrel in the first rotational direction.

6. The method of claim 1, in which the casing running tool comprises a make-up activation sleeve that is displaced in a first longitudinal direction in the rotating the mandrel in the first rotational direction, and in which the make-up activation sleeve is displaced in a second longitudinal direction opposite to the first longitudinal direction in the rotating the mandrel in the second rotational direction.

7. The method of claim 6, in which the casing running tool comprises a break-out activation sleeve that is displaced in the second longitudinal direction in the rotating the mandrel in the first rotational direction, and in which the break-out activation sleeve is displaced in the first longitudinal direction in the rotating the mandrel in the second rotational direction.

8. A casing running tool for use with a subterranean well, the casing running tool comprising:

a tubular mandrel;

slips configured to grip a casing section in response to rotation of the mandrel;

a make-up activation sleeve configured to displace in a first longitudinal direction in response to rotation of the mandrel in a first rotational direction;

a break-out activation sleeve configured to displace in a second longitudinal direction opposite to the first longitudinal direction in response to the rotation of the mandrel in the first rotational direction; and a support secured to a slip cage configured to displace the slips between outwardly extended and inwardly retracted positions, in which relative rotation is prevented between the support and the make-up activation sleeve, and in which relative rotation is prevented between the support and the break-out activation sleeve.

9. The casing running tool of claim 8, in which the make-up activation sleeve is further configured to displace in the second longitudinal direction in response to rotation of the mandrel in a second rotational direction opposite to the first rotational direction.

10. The casing running tool of claim 9, in which the break-out activation sleeve is further configured to displace in the first longitudinal direction in response to rotation of the mandrel in the second rotational direction.

11. The casing running tool of claim 8, in which relative longitudinal displacement is permitted between the support and the make-up activation sleeve, and in which relative longitudinal displacement is permitted between the support and the break-out activation sleeve.

12. The casing running tool of claim 8, further comprising a biasing device and a latch mechanism, and in which the latch mechanism is configured to prevent a biasing force exerted by the biasing device from being applied to the slips when the latch mechanism is engaged with an internal housing of the casing running tool.

13. The casing running tool of claim 12, in which the biasing device is configured to compress in response to a longitudinal compressive load applied to the casing running tool.

14. The casing running tool of claim 13, in which the latch mechanism is configured to engage the internal housing in response to the longitudinal compressive load applied to the casing running tool.

15. The casing running tool of claim 12, in which the latch mechanism comprises a synchronization ring configured to prevent disengagement of multiple latch members from the internal housing when a longitudinally compressive load is not applied to the casing running tool, and the synchronization ring is configured to ensure that the latch members displace together.

16. The casing running tool of claim 12, in which a recess formed in the internal housing is configured to displace a latch member of the latch mechanism out of engagement with the recess in response to rotation of the internal housing.

17. The casing running tool of claim 16, further comprising a visual indicator configured to rotate in response to displacement of the latch member.

* * * * *